US005240446A

United States Patent [19]

Boatman et al.

[11] Patent Number: 5,240,446

[45] Date of Patent: Aug. 31, 1993

[54] DISCONNECTABLE MOORING SYSTEM

[75] Inventors: L. Terry Boatman, Katy; Charles O. Etheridge, Houston, both of Tex.

[73] Assignee: Sofec, Inc., Houston, Tex.

[21] Appl. No.: 985,129

[22] Filed: Dec. 3, 1992

Related U.S. Application Data

[63] Continuation-in-part of Ser. No. 767,026, Sep. 27, 1991.

[51] Int. Cl.[5] ..... B63B 22/02

[52] U.S. Cl. ..... 441/3; 114/230

[58] Field of Search ..... 114/230, 293; 441/3-5; 166/350-357

[56] References Cited

U.S. PATENT DOCUMENTS

| | | | |
|---|---|---|---|
| 3,407,768 | 10/1968 | Graham | 114/230 |
| 3,525,312 | 8/1970 | Beck | 114/230 |
| 4,321,720 | 3/1982 | Havre | 441/5 |
| 4,490,121 | 12/1984 | Coppens et al. | 441/5 |
| 4,604,961 | 8/1986 | Ortloff et al. | 114/230 |
| 4,637,335 | 1/1987 | Pollock | 441/4 |
| 4,650,431 | 3/1987 | Kentosh | 441/5 |
| 4,892,495 | 1/1990 | Svenson | 441/5 |

*Primary Examiner*—Edwin L. Swinehart

*Attorney, Agent, or Firm*—Bush, Moseley & Riddle

[57] ABSTRACT

An improved detachable mooring system (1) is disclosed of the kind including a rotatable turret (10) mounted on the vessel (5) and a buoyant spider buoy (20), secured by chains (22) to the sea floor, which may be selectively connected by means of a hydraulic connector (209) to the bottom of the turret (10). One improvement relates to providing a roller bearing (598) between an upper part of the turret and an interior ring (56) of a well (50) of the vessel (50) at a level higher than sea water can reach under fully loaded conditions of the vessel. Such improvement provides an elastomeric pad (584) between the bearing (598) and a support ring (56) to reduce moment loads and to compensate for manufacturing tolerances of interface surfaces of the bearing (580, 586) and the support ring (56). Alternatively one or more spring stacks (791, 793) may be used rather than an elastomeric pad. A further improvement provides support structure (102, 596, 590) which allows the bearing (598) to be removed for inspection, repair or replacement without removal of the turret (10). Another improvement relates to providing a passage through the hydraulic connector (30) and providing a chain locker (23') in the buoyant mooring element. The chain locker includes a restricted passage at its top end. A plug within the chain locker is connected at its top center to the chain. Such plug is pulled to the top of the chain locker when the chain is pulled so as to snub the top of the mooring element to the bottom of the turret. Another improvement relates to providing a female profile on the top of the mooring buoy and a cooperating male profile on the bottom of the turret to aid in the snubbing of the mooring buoy to the turret.

2 Claims, 16 Drawing Sheets

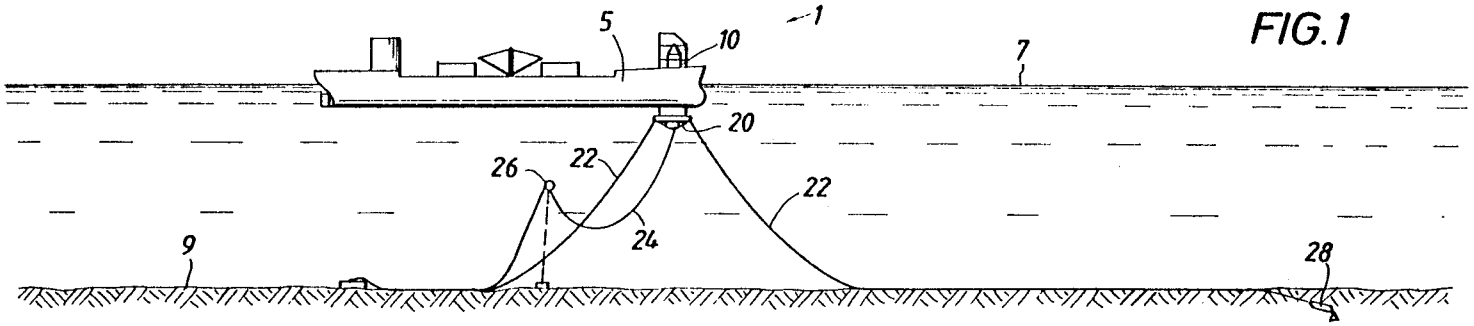
FIG. 1
1
5
10
20
22
24
26
7
28
9
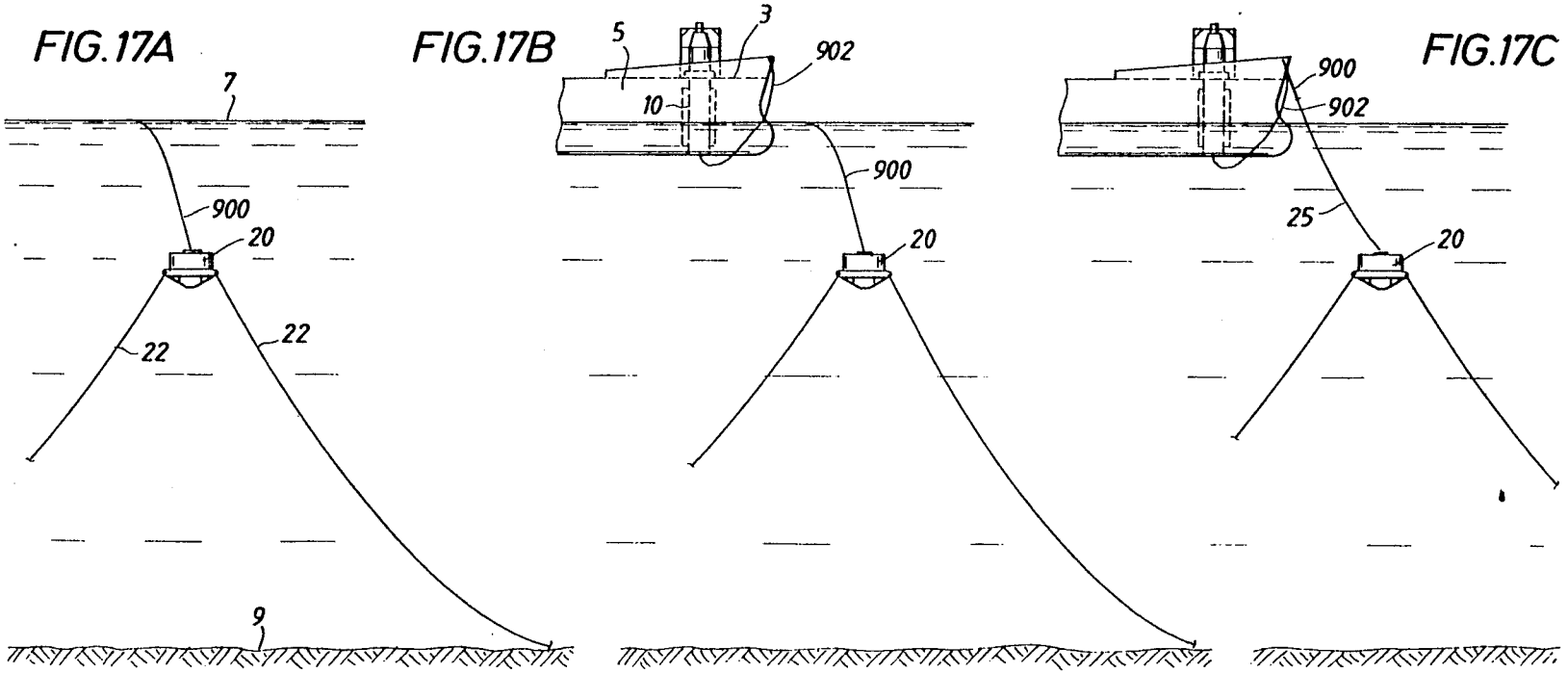
FIG. 17A
7
900
20
22
FIG. 17B
3
5
10
902
900
20
FIG. 17C
900
902
20
25
9

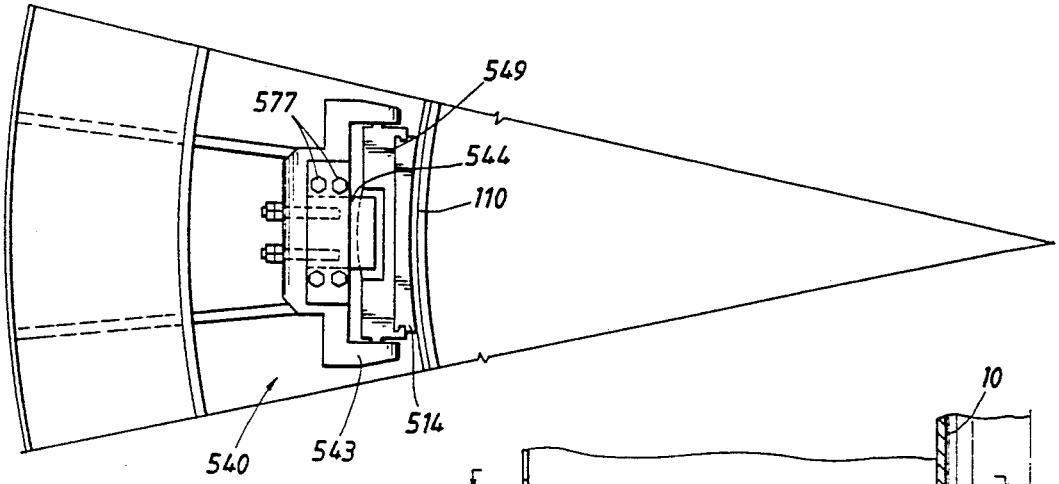
FIG. 14
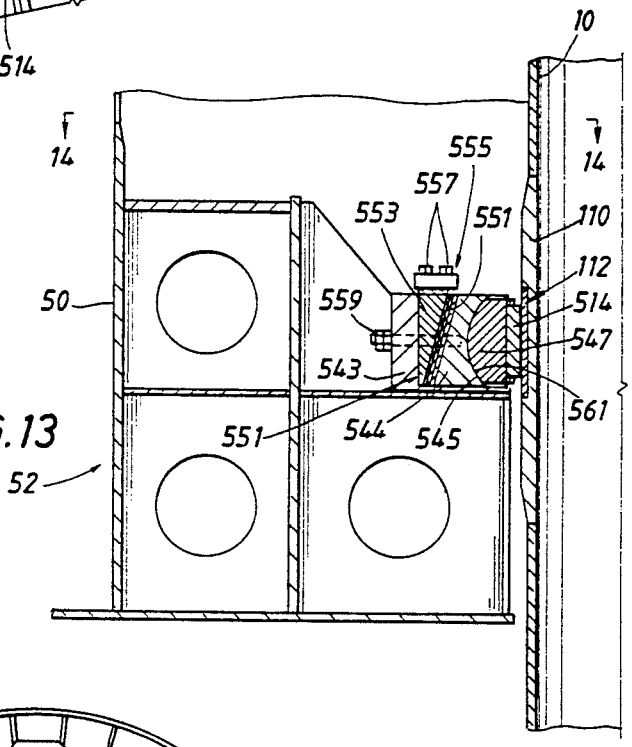
FIG. 13
FIG. 12
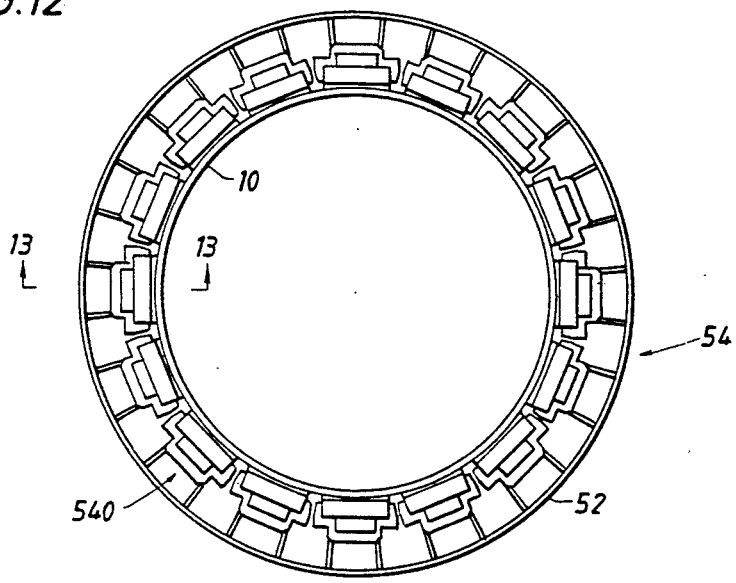

DISCONNECTABLE MOORING SYSTEM

CROSS REFERENCE TO RELATED APPLICATION

This application is a continuation-in-part of copending U.S. application Ser. No. 07/767,026 filed Sep. 27, 1991, pending.

BACKGROUND OF THE INVENTION

1. Field of Invention

This invention relates generally to vessel mooring systems. In particular, the invention relates to improved disconnectable mooring systems by which a mooring system supported by a buoyant assembly may be quickly connected and disconnected from a turret of a vessel.

2. Description of the Prior Art

With the occurrence of offshore sub sea production wells came the need for floating production vessels to accept the product of such wells. Certain offshore oil fields are in waters in which fierce storms occur or in which ice floes are present. For such environments there has developed disconnectable mooring systems so that a mooring element may be permanently placed at the field and connected and disconnected to the production vessel. When dangerous weather conditions are forecasted, the vessel disconnects from the mooring system and sails to safe harbor to wait out the storm or ice floe. The mooring system remains on location. When storm conditions pass, the vessel returns to the field, reconnects to the mooring system, and production resumes.

One such system is illustrated in U.S. Pat. No. 4,650,431 to Kentosh. Such patent issued Mar. 17, 1987 from a CIP application dated Sep. 15, 1980. The Kentosh patent illustrates a turret rotatably mounted to a ship. A mooring buoy may be connected and disconnected from the bottom of the turret. The mooring buoy is fixed to the sea floor by means of a plurality of anchors connected to the mooring element by catenary chains. One or more risers run from production wells on the sea floor to the mooring buoy where they are connected to conduits in the turret and ultimately to a product swivel to conduits running to holds in the vessel. The vessel includes bearings which provide support to the turret while allowing the vessel to weathervane about such turret under forces of wind, waves and currents.

The mooring system described in the Kentosh patent is supported by a buoy that can be mechanically connected to a turret. The level of buoyancy of such buoy and the weight and design of catenary chains and anchor system are coordinated such that when the vessel disconnects from the buoy, the weight of the chains cause the buoy, though buoyant, to sink. As the chains lay down on the sea floor with the sinking of the buoy, less and less downward force is applied to it the deeper the buoy sinks. An equilibrium point is reached where the upward force due to the buoyancy balances the downward force of the chains. An equilibrium depth of at least five meters below average sea level is described to avoid damage from ice packs and to reduce wave action forces. A marker buoy is attached via a line to the mooring element.

U.S. Pat. No. 4,604,961 issued Aug. 12, 1986 to Ortloff et al (Ortloff) based on an application filed Jun. 11, 1984. A well or moon pool is provided between the bow and stern of the productive vessel. A turret is rotatably secured in the well at a position at the bottom of the vessel. A mooring system may be connected or disconnected to such turret. Once the mooring system is connected to the turret, the vessel is free to weathervane about the turret by means of anchors and catenary chains that are secured to the sea floor. The buoy supporting the mooring system is stored beneath the sea surface when the vessel disconnects from the mooring element. Like in the Kentosh system, the buoyancy of the Ortloff support buoy is designed such that it reaches equilibrium against the decreasing downward forces of the catenary chains with the sinking of the mooring element.

A published paper, OTC 6251, titled *Innovative Disconnectable Mooring System for Floating Production System of HZ-21-1 Oil Field at Huiyhon, South China Sea* by G. O'Niox, et al., presented at the 22nd Annual Offshore Technology Conference, May 7–10, 1990 describes a disconnectable buoyant turret mooring system to moor a tanker floating production system.

The described system includes a turret located in the forepeak structure of a tanker floating production system. Eight equally spaced catenary anchor legs are connected to the turret by means of a submerged buoy. The buoy is connected to the turret structure by means of a collet type structural connector. During connection operations of the buoy to the turret, a wire rope connected to the buoy is hauled in on a drum winch located on the deck of the vessel.

The turret of the O'Nion system is supported to the vessel by a three-race roller bearing, located just above the keel structure of the vessel. Such bearing allows the vessel to weathervane about the turret fixed to the sea floor by means of a buoy/catenary line/anchor system.

Mooring loads between the vessel and the buoy/turret are transmitted via the three-race roller bearing. Bending moment loading on the turret occurs because the supporting three-race roller bearing is axially separated from the connector which secures the turret to the mooring buoy.

The O'Nion system includes a re-connection wire rope which dangles below from an axial passage of the buoy. A floating mooring line extends from the surface of the sea to the top end of the re-connection wire end of the buoy. The floating synthetic mooring line is used to draw the vessel to the mooring buoy by heaving in the mooring line with a winch on the deck of the vessel. The re-connection wire rope is ultimately heaved in from beneath the mooring buoy as it is slowly drawn through the axial passage through the buoy and up into the turret. Lifting of the buoy is achieved by heaving in the reconnection wire rope.

The buoy is guided into registration with the turret by a guide pin facing downward at the bottom of the turret. With the buoy held firmly under the vessel by the upward tension in the wire rope, the turret is rotated with respect to the vessel until the buoy and turret have their respective riser tubes aligned. Once alignment is confirmed, either directly visually with a diver or indirectly visually by means of video equipment, the guide pin is extended downwardly into a hole in the top deck of the buoy. The connector between the turret and the buoy is then engaged. The risers extending to the buoy are then connected to risers of the turret.

While the O'Nion system offers advantages over disconnectable mooring systems which preceded it, there are a number of disadvantages inherent in its design.

First, the single bearing which supports the turret near the hydraulic connector at the bottom of the turret is submerged and must be protected against ingress of sea water and is subject to relatively large dynamic moment loads, axial loads and radial loads.

Second, the hydraulic connection between the bottom of the turret and the top of the buoy must for practical reasons be of relatively small dimensions compared to the mass of the attached mooring buoy and anchor leg system. The components of the connector will consequently be subject to relatively large stress variations and also to stress reversals, due to the dynamic moment loads that will be acting directly on the connector during rough weather conditions. Such stress variations and reversals greatly increase the probability of fatigue failure of the connection. The hydraulic connection does not appear to have a mechanism to establish preload tension between the hydraulic connector of the turret and a connector hub atop the buoy. Furthermore, there appears to be no means to achieve automatic alignment of the turret with the buoy when the hydraulic connector connects to the connector hub.

Third, with the O'Nion system, it appears difficult to obtain the required rotational alignment between the turret and the buoy during the connection operations. There will be relatively high friction resistance to rotational movements between the turret and the buoy during the final stages of the pull-up operation. The reaction to rotational movement of the buoy afforded by the anchor chains will be too compliant to enable the final adjustment to be made within the required tolerance. Furthermore, the O'Nion system seems to require direct observation of an alignment pin on the turret with an alignment hole on top of the buoy.

Fourth, the O'Nion system does not appear to provide a way to test the mating and connection between the bottom of the turret and the top of the buoy prior to deployment of the vessel and mooring system in the sea.

The O'Nion system also does not provide an arrangement for storage and tangle-free deployment of a soft messenger line connected to the buoy mooring link during disconnection of the mooring buoy from the turret.

3. Identification of Objects of the Invention

The disadvantages of the O'Nion system and other prior systems prompted the disconnectable mooring system of this invention. Certain objectives can be identified as follows:

1. Provide connector apparatus for establishing preload tension between a collet flange hub of the spider buoy and a hydraulic powdered connector at the bottom of the turret. Establishment of such pre-load eliminates stress reversals in the connector assembly to minimize the risk of fatigue failure in these components.

2. Provide apparatus for disconnecting the connector at the bottom of the turret and raising it to an upper deck of the vessel for inspection and maintenance service while the mooring element is connected to the turret.

3. Provide apparatus for remotely sensing the level of pre-load tension in the connector.

4. Provide an arrangement by which the collet connector may have self-aligning support with respect to the bottom of the turret so as to compensate for small misalignment between the spider buoy and the turret.

5. Provide a thrust bearing between an upper part of the turret and an interior support ring of a well of the vessel at a level to preclude sea water intrusion during fully loaded conditions so as to provide upper level axial support of the turret and also provide lower level radial support.

6. Provide a self aligning seating arrangement between the thrust bearing and a support ring to reduce moment loads and to compensate for manufacturing tolerances of interface surfaces of the bearing and the support ring.

7. Provide a support structure arrangement by which the thrust bearing may be removed for inspection, repair, or replacement without removal of the turret.

8. Provide a connection arrangement between the turret and the mooring element so as substantially to minimize bending moments in the connector apparatus.

9. Provide a lower radial support bearing assembly that is self aligning with the turret journal when the turret's axis is not precisely parallel with the axis of the radial support and when the large turret outside journal is not precisely round.

10. Provide alignment pins on the bottom of the turret and alignment slots on the top of the spider buoy for non-visual alignment of the turret with the spider buoy during its connection to the turret.

11. Provide hydraulically driven shock absorbers (spacer bumpers) which separate the top of the mooring spider from the bottom end of the turret so as to allow the turret to be rotated during connection and alignment of the turret and the mooring spider.

12. Provide the turret structural arrangement to be manufactured in separate top, middle and bottom sections to be joined after machining of surfaces of the top and bottom sections.

13. Provide a method of manufacture to include mating and testing the connection between the top of the mooring element and the bottom of the turret prior to deployment of the vessel and mooring buoy in the sea.

14. Provide means for storing the buoyant messenger line and to facilitate its tangle free deployment in the sea when the spider buoy is disconnected from the turret.

SUMMARY

The objects of the invention identified above as well as other advantages and features of the invention are incorporated in improvements to a disconnectable vessel mooring system of the kind in which a vessel includes a structure for mounting a turret about which the vessel may weathervane when the turret is secured to the sea floor by means of a detachable spider buoy. Such spider buoy (or "mooring element") is buoyant and is of the kind that is secured to the sea floor by catenary lines, anchored to the sea floor. When the spider buoy is detached from the turret, the weight of the catenary lines force the buoy downwardly such that decreasing downward force of the lines results as the lines lie down on the sea floor. An equilibrium position is reached where the upward force of the buoyancy of the spider buoy matches the downward weight of the chains. Such mooring system includes a connection apparatus to connect the bottom of the turret to the top of the spider buoy.

One improvement relates to connection apparatus of the kind in which a collet flange hub is mounted at the top of the spider buoy and a hydraulically powered collet connector is mounted to the bottom of the turret. The improvement includes apparatus for establishing pre-load tension in the connection between the collet flange hub and the collet connector and thereby drawing the spider buoy into firm contact with the bottom of the turret to achieve high rigidity and strength in the connection while eliminating stress reversals.

Another improvement relates to apparatus for mounting such collet connector with respect to the bottom of the turret such that the connector self-aligns with the turret when the spider buoy is connected to it. Such feature corrects for small axial misalignment between buoy and turret (caused by sea growth on mating surfaces, for example) and also allows the connector attached to a bottom section of the turret to be tested with the spider buoy prior to the time the bottom section of the turret is connected to the middle and upper sections.

Another improvement relates to apparatus by which the collet connector may be raised to the top of the turret while the vessel is connected to the mooring system in operation. Such apparatus includes a removable key which secures the collet connector to a support ring of the turret and apparatus for hoisting the collet connector upwardly within the turret.

Another improvement relates to apparatus for remotely sensing the level of pre-load tension in the connector assembly. Such apparatus includes a strain gauge placed in the wall of a piston cylinder assembly which establishes pre-load tension in the connector and includes electrical leads connected to a monitor at an operations station of the vessel.

Another improvement relates to axially and rotationally supporting the turret with a low friction bearing at a location well above the height to which sea water may rise under full load conditions of the vessel. The axial mounting includes an elastomeric mounting ring assembly between a three row roller bearing and a support ring mounted to the vessel. Such elastomeric mounting reduces moment loads on the bearing and compensates for manufacturing tolerances necessary for machined surfaces.

Another improvement relates to a coupling structure for coupling the turret to the bearing which may be decoupled while the turret is in the well of the vessel so that the bearing components may be removed for inspection, cleaning, etc.

Another feature of the invention relates to providing a detachable mooring system in which a turret is axially supported in a well of a vessel at an upper location of the well and is radially supported at a bottom location of the well.

Another improvement relates to providing alignment pins which face downwardly from the bottom of the turret and alignment slots on the top of the spider buoy by which the turret may be rotationally aligned prior to final connection. Such pins and slots are arranged so that if the turret is out of rotational alignment by less than a predetermined angular rotation, at least one pin will be accepted by a slot. Rotation of the turret with respect to the vessel then brings the turret into complete rotational alignment with the spider buoy. At that time the other alignment pin may be inserted into the other alignment slot.

Another improvement of the invention provides powered bumpers by which the spider buoy is forced away from the bottom of the turret a small distance during the time that the turret is being rotated for precise rotational alignment with the spider buoy. Such small distance between the bottom of the turret and the top of the spider buoy facilitates rotation of the turret during rotational alignment.

Another feature of the invention provides a radial bearing structure at the bottom end of a well of the vessel. Such structure includes a plurality of radial bearing assemblies secured about a support ring secured to the well. Each bearing assembly includes a bearing for automatically adjusting its orientation with respect to the support ring to maintain substantially constant engagement of an attached bushing against the turret when the turret axis is not parallel with the support ring axis and when the outer surface of the turret is out-of-round.

Another feature of the radial bearing includes means for adjusting the radial placement of each bearing assembly about the support ring so that flush engagement of a bushing of the bearing is achieved after the turret is placed within such ring.

Another feature of the invention provides a method of manufacturing the turret system in which the lower section of the turret is fabricated separately from middle and upper sections and in which the hydraulic connector is installed at the bottom end of such lower section. Before the lower section of the turret is mounted on the vessel, the mooring element is mated to the bottom end of the lower section of the turret, and the hydraulic connector of the turret is connected to the collet flange hub of the mooring buoy. Such testing steps are part of the manufacturing process of the invention.

Still another feature of the invention includes a structure for storage and tangle-free deployment of a floating messenger line by which such line is deployed when the spider buoy is disconnected from the turret. Such line has one end connected to a chain which is stored within a chain locker.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 1 is a schematic of the system of which improvements and features of the invention are incorporated, where the system includes a vessel, a turret about which such vessel may weathervane and a disconnectable spider buoy secured to the sea floor by anchor legs with piles or drag embedment anchors;

FIG. 12 is a section view looking downwardly on the turret and the lower bearing assembly;

FIG. 13 is a section along lines 13—13 of FIG. 13 which illustrates a radial bearing assembly;

FIG. 14 is a top view of the radial bearing assembly of FIG. 13;

FIGS. 17A-17I illustrate operational steps in the connection of the mooring system to a vessel at sea and the disconnection of same.

DESCRIPTION OF PREFERRED EMBODIMENT OF THE INVENTION

Figure 2:
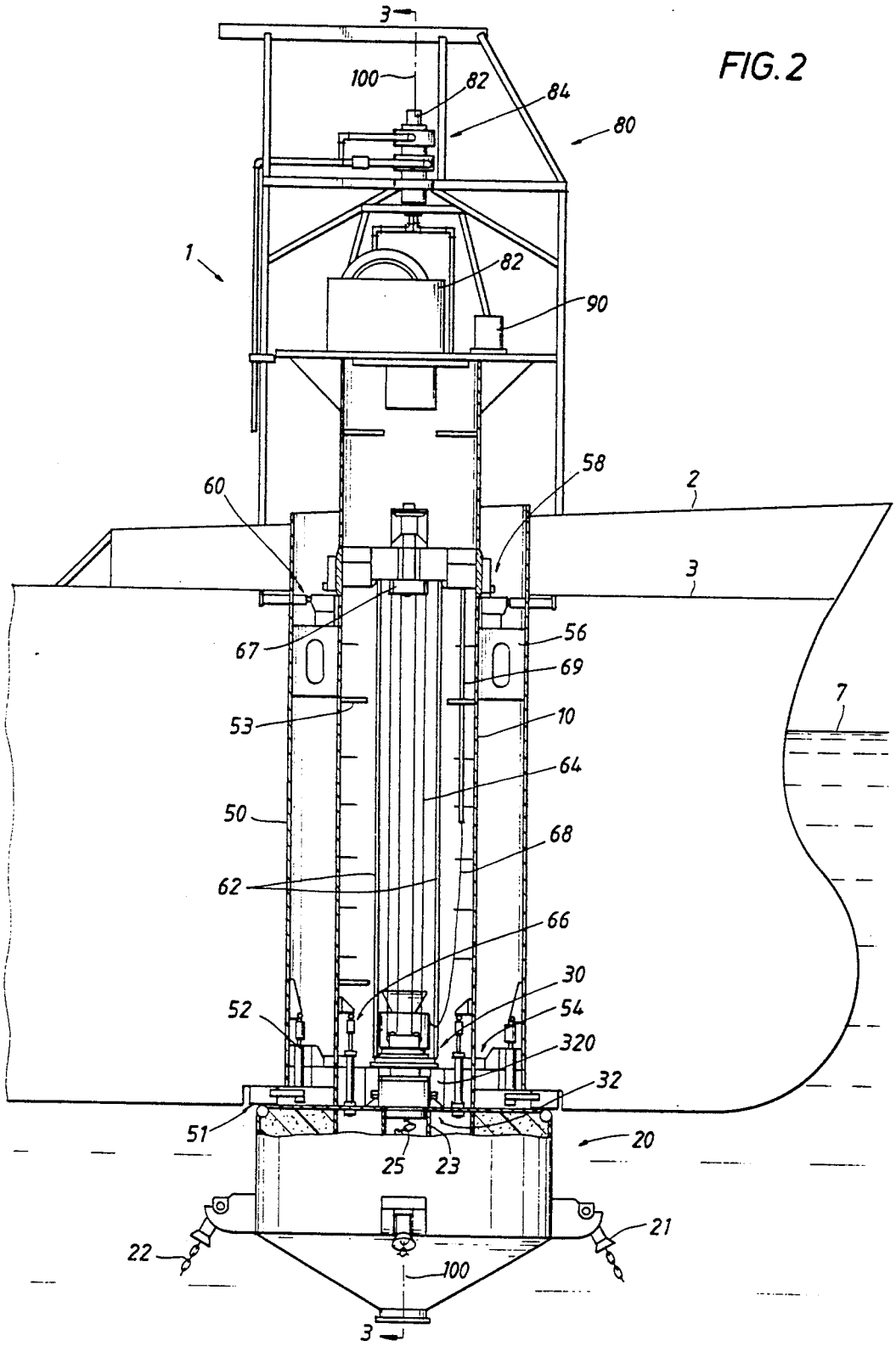
FIG. 2 is a longitudinal section of the vessel showing a turret supported within a well or turret insert tube with a disconnectable spider buoy attached thereto.

FIG. 1 illustrates a disconnectable mooring system 1 of the invention including a vessel 5 having a rotatable turret 10 mounted thereon. A disconnectable spider buoy 20 (also referred to as a "mooring element" and as a "mooring buoy") is also shown connected to the bottom of a turret mounted on vessel 5 for relative rotation. With spider buoy 20 connected to the sea floor 9 by means of anchor legs 22 to anchors 28, (e.g., piles or drag embedment anchors) the turret 10 is not free to rotate and vessel 5 may weathervane about turret 10. When spider buoy 20 is disconnected from turret 10, such turret 10 may be rotated with respect to vessel 5 by hydraulic drive motor/gear mechanisms illustrated below.

One or more flexible risers 24 extend from lines to subsea wells, for example, to mooring buoy 20. Such risers extend upwardly through mooring buoy 20, and connect with corresponding piping in the turret 10 which run to a product swivel and piping that continues to holds in vessel 5.

OVERVIEW OF THE IMPROVED DISCONNECTABLE MOORING SYSTEM

Figure 3:
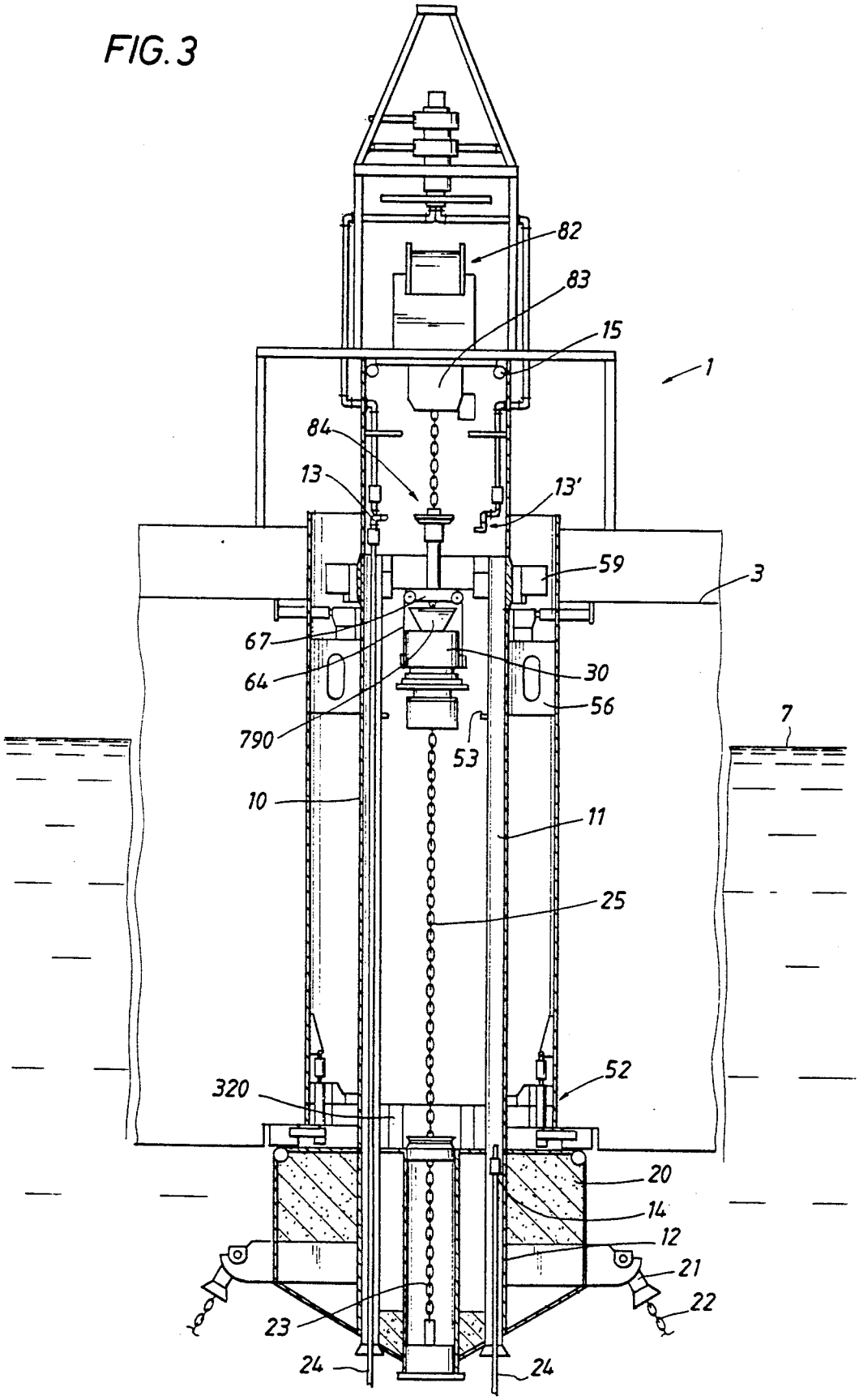
FIG. 3 is a transverse section of the vessel taken along section lines 3—3 of FIG. 2.

FIGS. 2 and 3 illustrate in longitudinal and transverse sections the improved disconnectable mooring system according to the invention. Details of the various structures and systems described here follow below by reference to more detailed figures.

A turret 10 is supported in a vessel well (also known as a turret insert tube) 50 by means of an upper turret support assembly 56 and a lower turret support 52.

An upper bearing assembly 58 rotatably supports turret 10 with respect to vessel 5 from upper turret support assembly 56. A lower bearing assembly 54 radially supports turret 10 with respect to vessel 5 from lower turret support assembly 52.

Tension connector 30 is mounted at the bottom end 32 of turret 10 from lower turret support assembly 52. Such connector 30 selectively connects with a collet flange mounted on the top face of spider buoy 20. An alignment mechanism 66 includes hydraulically driven pins from the bottom of turret 10 which are placed in slots on the top face of spider buoy to aid rotational alignment during connection of the spider buoy 20 to the turret 10.

As illustrated in FIG. 2, spider buoy 20 includes a chain locker 23 disposed axially in the buoy. A mooring chain 25 is stored within locker 23 when it is not being used to pull spider buoy 20 against the bottom end 32 of turret 10.

A bumper assembly 51, mounted in a recess at the bottom of well 50, serves to absorb shocks between the spider buoy 20 and the turret 10 when snubbing operations are performed while connecting the buoy 20 to the turret.

As best seen in FIG. 3, a turret drive assembly 59 serves to rotate the turret 10 with respect to the vessel 5 before spider buoy 20 is attached to the turret 10 by means of connector 30.

FIG. 3 also shows that when turret 10 is connected to spider buoy 20, riser guide tubes 11 of turret 10 are rotationally aligned with tubes 12 of buoy 20 so that flexible risers 24 may be raised through tubes 11 and 12 and connected to turret piping 13 (see left hand side of FIG. 3). On the right hand side of FIG. 3, a riser assembly 14 is shown in tube 12 for raising flexible riser 24 to turret guide tube 11. Riser connection winch 15 and a running tool serve to raise riser 24 to connection of turret piping 13' (shown unconnected on right hand side of FIG. 3).

As described in detail below, tension connector 30 may be disconnected from spider buoy 20 even while vessel 5 remains connected to buoy 20. This feature allows connector 30 to be raised to a work platform 53 above 100% loaded draft level 7 so that it may be inspected, tested, repaired etc. This is accomplished by snubbing buoy 20 to the bottom of turret 10 by tensioning mooring chain 25 by means of mooring winch assembly 82 acting through a level wind assembly 83 and a chain jack assembly 84. Tension connector 30 is raised by means of wire rope 64 and winch 67 with sheaves placed on connector 30 and winch 67. Connector 30 is guided between upper and lower positions by connector rails 62 (FIG. 2).

As illustrated in FIG. 2, a hydraulic power unit 90 serves to supply pressurized hydraulic fluid selectively via conduit 69 and hydraulic leads 68 to tension connector 30, alignment mechanism 66, turret drive assembly 59 (FIG. 3) and other devices where hydraulic power is required. Electrical leads are also provided via conduit 69 and leads 68.

DESCRIPTION OF TENSION CONNECTOR 30 (FIG. 4)

Figure 4:
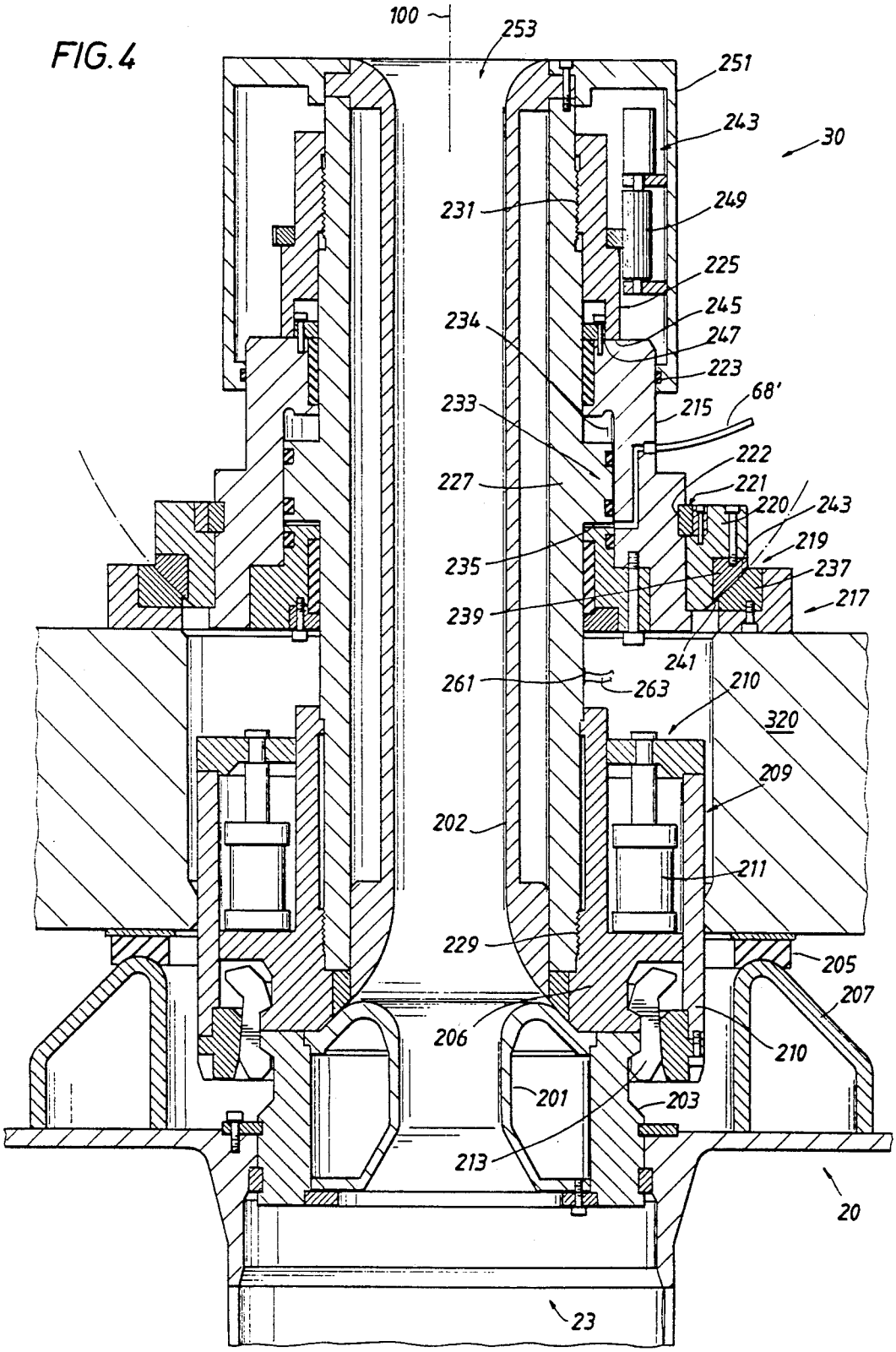
FIG. 4 is a cross section of the tension connector of the invention.

FIG. 4 illustrates tension connector 30 latched to collet flange hub 203. Tension connector 30 includes a collet connector 209 which includes hydraulically driven collet cylinders 211 which drive bear locks 213 into or out of locking engagement with flange hub 203 by lowering or raising ring 210. Such collet connector 209 and flange hub 203 may be provided from Cameron Iron Works of Houston, Tex., for example. The improved tension connector 30 includes a piston 227 connected by threads 229 to connector body 202. Piston 227 includes a piston head 233 which fits within a annular cavity 234 of hydraulic cylinder 215. Piston head 233 has a bottom shoulder 235. Hydraulic fluid may be inserted selectively beneath head 233 via port 236 of cylinder 215 from hydraulic line 68'.

Hydraulic cylinder 215 is supported from the bottom of turret 10 through support devices connected to ring 320. Ring 320 is part of the lower turret assembly 52, best illustrated in FIGS. 2, 3 and 6. Such support devices include a turret support ring 217 and a cylinder support ring 220 which cooperate with each other to form a self-aligning support 219. Turret support ring 217 includes an inwardly facing spherical annular seat 237. Cylinder support ring 220 includes an annular ball 239 having a ball surface 241 which is supported on seat surface 243 of seat 237.

Cylinder support ring 220 is removably secured to hydraulic cylinder 215 by means of a removable segmented ring key 221, removably secured to ring 220, and placed in groove 222 in the outer wall of cylinder 215. With ring key 221 removed from groove 220 and with the bear locks 213 of collet connector 209 unlatched from collet flange hub 203, the entire combination of collet connector 209, piston 227, cylinder 215, etc. of tension connector 30 may be raised by winch 67 and tackle (including sheaves and wire rope 64) while being guided on connector rails 62 (see FIG. 2).

Connected by means of nut threads 231, nut 225 has a downwardly facing shoulder 245 which faces upwardly facing shoulder 247 of cylinder 215. A hydraulic motor 243 has an output shaft with gears 249 to rotate nut 231 selectively so as to drive nut 231 downwardly with respect to piston 227 on nut threads 231. Connector cover 251 includes water seals 223 to prevent sea water from entering the space inside cover 251 so as to prevent contamination of motor 251 and nut 25, etc.

A spider buoy chain guide 201 cooperates with a tension connector chain guide 202 to form an axial passage 253 through which mooring chain 25 may pass from connection to the bottom of mooring buoy chain locker 23 to mooring winch assembly 82 (see FIG. 3).

A guide ring 207 extending upwardly from the top surface of spider buoy 20, not only serves to help axially align the mooring buoy 20 to the bottom of the turret 10 during connection operations, it also is adapted to press against water seal 205 secured to support ring 320. Guide ring 207 and water seal 205 cooperate to substantially prevent sea water from entering the interior region of collet connector 209 after the buoy is connected to the turret.

After the collet connector 209 is connected to collet flange hub 203, hydraulic pressure is applied via hydraulic line 68' to the annular space beneath piston shoulder 235. As a result, piston 227 and collet connector 209 with its body 206 are forced upwardly. Concurrently, hydraulic cylinder 215 is forced downwardly through self-aligning support 219 against ring 320. Consequently, tension force is established between collet connector 209 and collet flange hub 203. Such tension force of course is offset by compressive force of hydraulic cylinder 215 against support ring 320. The pre-load tension force of piston 227 is locked in by threading nut 225 downwardly by operation of hydraulic motor 243 until downward facing surface 245 of nut 225 is stopped by upwardly facing surface 247 of cylinder 215. After such engagement, the nut 225 is prevented from substantial axial motion by threads 231, and hydraulic motor 243 has its hydraulic pressure removed. Next, hydraulic pressure via line 68' is removed thereby relaxing outside force tending to drive piston 227 axially upwardly with respect to cylinder 215. But as a result, cylinder 215 is trapped between nut 225 and ring 320 via support 219. The piston 227 is substantially prevented also from relaxation downwardly by nut 225 and hydraulic cylinder 215. Consequently, the tension applied to piston 227 and collet connector 209 and collet flange hub 203 is substantially retained or "locked in" and results in the desired pre-load tension in the connector components and pre-load compression in the contact surface between the spider buoy and the lower end of the turret.

Piston 227 is elongated or stretched a small distance as a result of the locked in tension applied to it. In other words, it is subjected to mechanical strain. A strain gauge 261 placed on the piston 227 wall subjected to tension is connected via electrical leads 263 to a strain gauge monitor (not illustrated) placed among control equipment of upper decks of the vessel. Such strain gauge monitors the level of pre-load tension applied to tension connector 30.

The self-aligning support 219 offers advantages not achieved in prior disconnectable mooring systems. Its ball and spherical seat design enables the spider buoy 20 to be slightly misaligned with respect to the turret 10. Such misalignment might occur, for example, because of marine growth forming on the upper surfaces of the spider buoy 20 after it has been disconnected and remained in the sea prior to the return of the vessel. By connecting the spider buoy 20 to the turret 10 via self-aligning support 219 and tension connector 30, the buoy 20 essentially may "roll" in the self-aligning support 219 thereby allowing small axial and angular misalignment between buoy 20 and turret 10 while simultaneously providing firm connection between spider buoy 20 and turret 10 by tension connector 30.

After the spider buoy 20 is connected to turret 10 and the production vessel 5 has been in operation for a time, it may be desirable to inspect and or repair or test tension connector 30. Operationally, mooring chain 25 is raised (see FIGS. 2 and 3) from chain locker 23 upwardly via axial passage 253 (FIG. 4) by mooring winch 82 and chain jack assembly 84. As a result, spider buoy 20 is forcefully snubbed against the bottom of turret 10. Next, collet connector 209 is unlatched. At that time, winch 67 (see FIG. 2) is activated to raise tension connector 30 via wire ropes 64 and sheaves on connector rails 62. As shown in FIG. 3 connector 30' is shown in an upper position where it may be inspected and repaired by workmen from work platform ring 53 secured to the interior of turret 10.

DESCRIPTION OF UPPER BEARING

Figure 5:
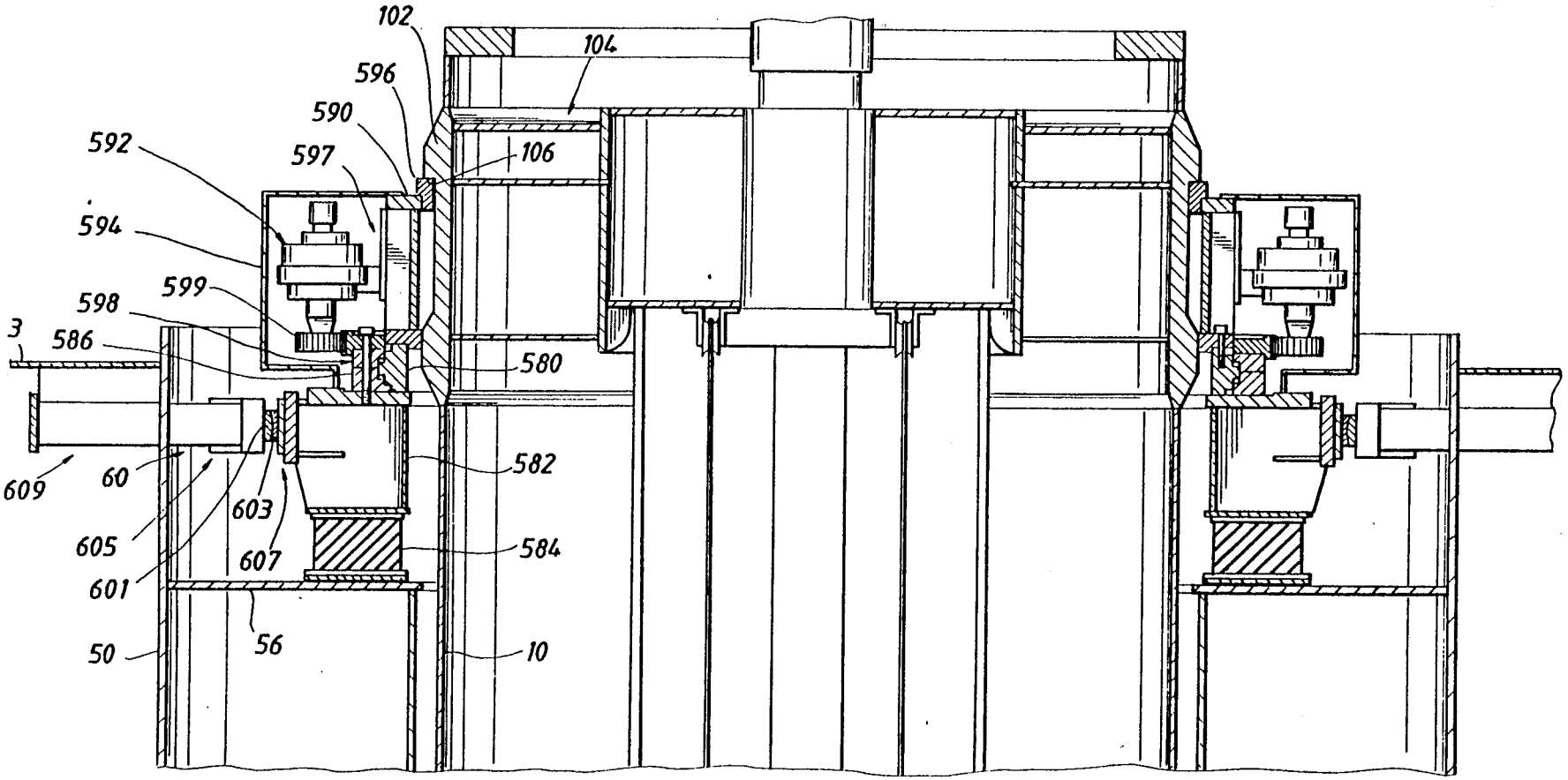
FIG. 5 is a section of the upper bearing assembly and horizontal bearing assembly by which the turret is rotatably supported and radially supported at its upper end.

FIG. 5 provides a more detailed view of the upper bearing assembly 58 and horizontal bearing assembly 60 shown in FIG. 2. An upper turret support assembly or ring 56 is secured to the inner periphery of well or turret insert tube 50. An upper bearing support ring 582 is supported on ring 56 by an upper bearing elastomeric pad 584 which preferably comprises a number of equally spaced blocks suitably reinforced of elastomeric material such as rubber.

The entire upper bearing support ring 582 is supported horizontally or radially supported by horizontal bearing assembly 60, which preferably includes a number of equally spaced assemblies like the one illustrated in FIG. 5. Each horizontal bearing assembly 60 includes an inwardly facing ball 601 supported from well 50 by a first support structure 605 and an outwardly facing spherical set 603 supported from ring 582 by a second support structure 607. Such ball and seat arrangement allows the upper part of turret 10 to be supported radially as turret 10 and well 50 rotate with respect to one another. Such radial support at the ball 601 and 603 seat surfaces can be characterized by ball 601 sliding on seat 603 for small angular distances as radial imbalances between the top section of turret 10 and well 50 are encountered at each of the horizontal bearing assemblies 60. Each horizontal bearing assembly 60 includes additional radial structure support in vessel 5 as indicated by the structure referred by numeral 609.

An upper bearing race 586 is secured to upper bearing support ring 582. An inner bearing race 580 is supported within outer race 586. Bearing assembly 598 is preferably a three row roller bearing. Such bearing 598 is secured to an upper bearing retainer ring 590. The upper section of turret 10 includes a machined surface 102 which includes a downwardly facing annular shoulder 106. A segmented shear ring 596 is placed between the shoulder 106 of machined surfaced 102 and the upper bearing retainer ring. Accordingly, the entire turret 10 is axially and rotationally supported with respect to vessel 5 and its well 50 by means of upper bearing 580. Such bearing is placed above the 100% loaded draft level 7 (FIG. 2) of the vessel to assure that sea water does not have access to such bearing.

FIG. 5 also illustrates turret hydraulic drive motor 592 which provides rotation of turret 10 with respect to well 50 before fixed connection to the spider buoy is achieved.

Preferably two drive motors 592 are provided and spaced 180° about turret 10. Each motor is preferably secured to turret 10 by a support structure 597 from upper bearing retainer ring 590. The output shaft of motor 592 is coupled to well 50 via a segmented turret bull gear 599. A segmented cover 594 protects motor 592.

The segmented shear ring 596 may be removed while turret 10 is supported vertically by other means (for example a chain and bridle arrangement suspended from mooring winch assembly 82). With shear ring 596 removed, thrust bearing 598 may be repaired or replaced, after which turret 10 may again be supported axially on thrust bearing 598 via a newly installed shear ring 596.

The upper bearing elastomeric pads 584 serve to absorb vertical shocks between the turret 10 and vessel 5. They also function to reduce moment load imbalances between turret 10 and vessel 5 and to compensate for manufacturing tolerances of the upper bearing supports.

ALTERNATIVE EMBODIMENT OF UPPER BEARING

Figure 5A:
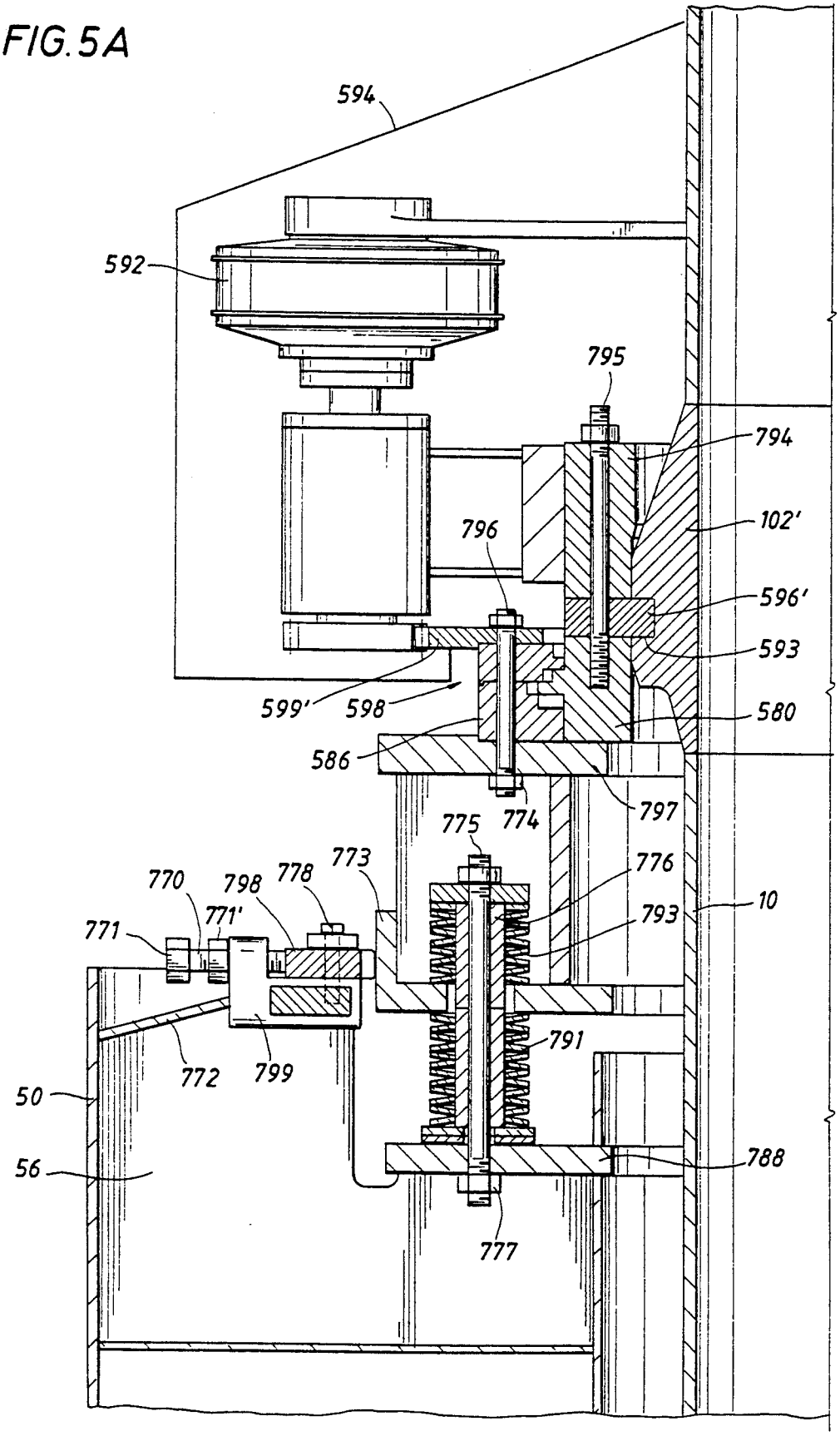
FIGS. 5A and 5B illustrate an alternative construction of an upper bearing assembly for mounting the upper part of the turret to the vessel; where
Figure 5B:
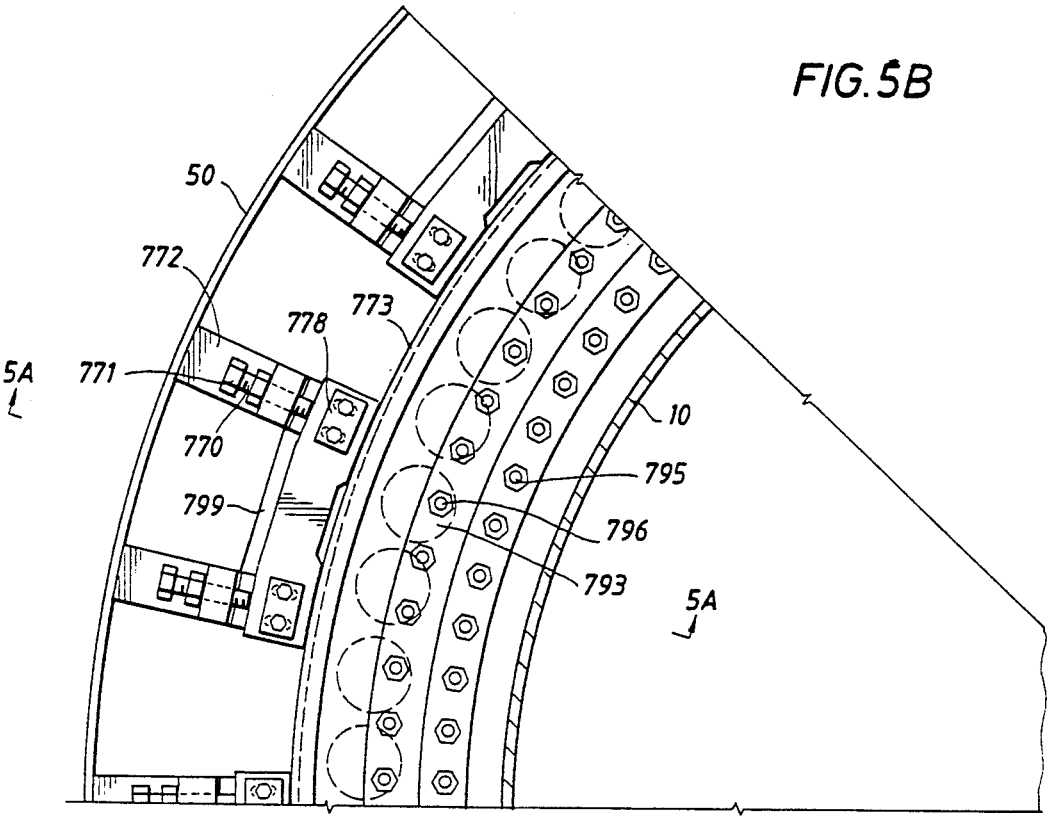

FIGS. 5A and 5B illustrate an alternative embodiment of the upper bearing of FIG. 5. FIG. 5A is a cross section of a portion of the vessel showing one bearing element of a plurality of elements placed in the annulus between well 50 and turret 10. The hydraulic turret drive assembly 592 (shown in elevation) is secured to the turret 10 and is protected by a segmented cover 594. Preferably two hydraulic turret drive assemblies are provided at 180° spacing about turret 10. Such turret drive assemblies drive a segmented bull gear 599' which is secured to the outer upper bearing race 586 of thrust bearing 598.

Inner bearing race 580 is fastened to turret 10 by means of a stud 795 sandwiching segmented shear ring 596' between the inner bearing race 580 and retainer ring 794. Segmented shear ring 596' is placed in a hole 595 of surface 102' of turret 10. Accordingly, as turret 10 turns, so does ring 596' and inner bearing race 580 with respect to outer bearing race 586.

The thrust bearing 598 is carried by and secured to support ring 797 by means of stud 796 and nut 774. Support ring 797 in turn is fastened (e.g., by welding) to support bracket 773. A bearing mount structure 788 is fixed to an upper bearing support structure 56. A lower spring stack is placed between support bracket 773 and the bearing mount structure 788. Accordingly, the entire outer portion of the thrust bearing assembly is resiliently mounted to the well 50 by means of the lower spring stack 791 elements placed about the annulus between well 50 and turret 10. Lower spring stack 791 preferably includes disk springs or bellville washers to provide the resilient support between support bracket 773 and bearing mount structure 778. Support bracket 773 is capable of limited radial movement with respect to stud 775 and nut 777 which fastens an upper spring stack 793, support bracket 773, lower spring stack 791 and bearing mount structure 788 together. Guides 776 are placed between the interior space of upper spring stack 793, lower spring stack 791 and stud 775.

Support bracket 773 may be forced radially inwardly a small amount during installation of turret 10 in the well 50 by means of adjustment stud 770 which is threaded within base plate 799. Adjustment stud 770 engages the outer side of alignment plate 798 which is carried by base plate 799 but can be moved radially when stud 778 is not secured tightly to the base plate 799 via a threaded hole in such plate. The inner side of alignment plate 798 engages support bracket 773. Accordingly, the support bracket 773 is radially supported by means of a plurality of alignment plates 798 mounted via support plates 772 about the annulus between well 50 and turret 10.

The arrangement of FIGS. 5A and 5B is advantageous, because surface 102' of turret 10 need not be machined to make it have a perfectly round or circular outer surface. Instead, surface 102' may be slightly out of round and installed for vertical support by thrust bearing 598, support ring 797, support bracket 773, spring stacks 793 and 791 and ultimately to bearing mount structure 788 and well 50. During installation, each alignment plate may be adjusted radially about the annulus between well 50 and turret 10 so as to provide snug radial support for the turret 10 as it rotates within well 50 with upper spring stack. Such adjustment is accomplished by releasing stud 770 and inner nut 771', radially moving alignment plate 798 by means of adjustment stud 770, and then screwing stud 770' into base plate tightly and turning nuts 771' and 771 until they are snug against base plate 799.

MECHANISMS FOR AXIAL AND ROTATIONAL ALIGNMENT OF TURRET AND MOORING BUOY DURING CONNECTION

FIGS. 6 through 11 show mechanisms for axial and rotational alignment of turret 10 and mooring buoy 20. Such figures also show the method steps by which such mechanisms are employed to achieve such connection.

Figure 6B:
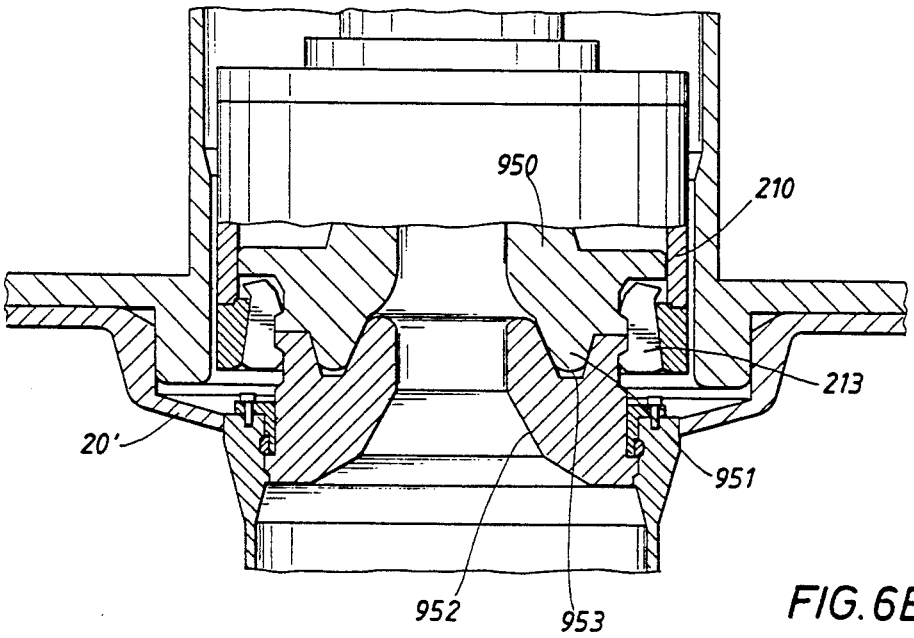
FIGS. 6A and 6B illustrate an alternative bottom profile of the turret and vessel and a cooperating alternative profile of the top portion of the mooring buoy.
Figure 6:
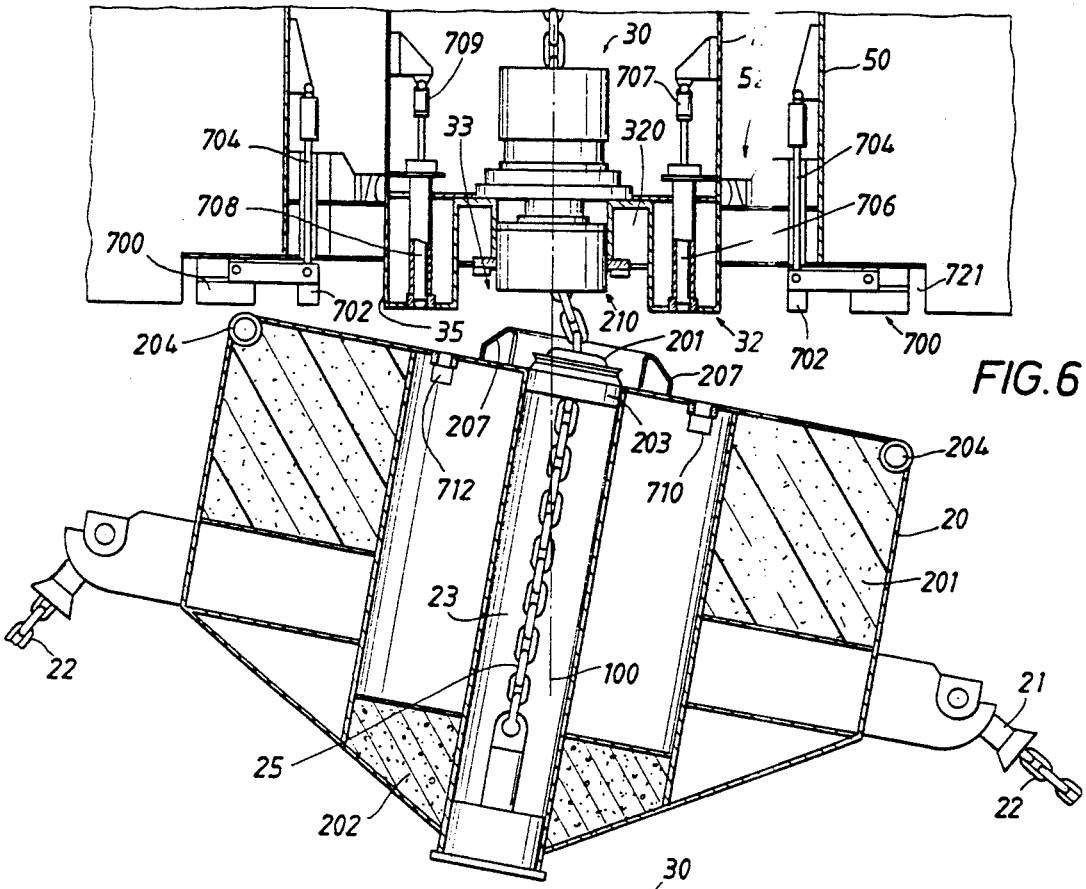
FIGS. 6 through 11 illustrate mechanisms for axial and rotational alignment of the turret and spider buoy during connection.

FIG. 6 illustrates a stage in the connection procedure where mooring chain 25 has been heaved in by mooring winch assembly 82 and final upward pulling of mooring chain 25 is being accomplished by chain jack assembly 84 (see FIG. 3).

Figure 10A:
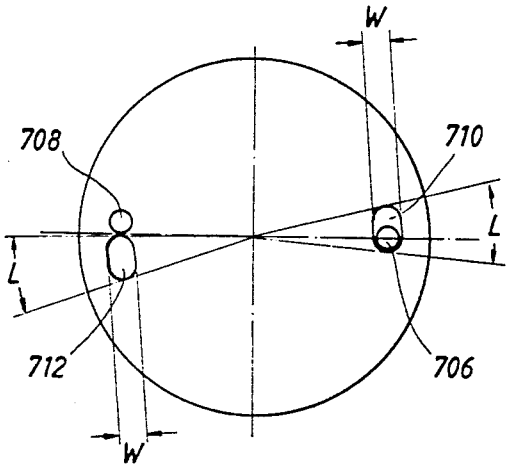
Figure 10B:
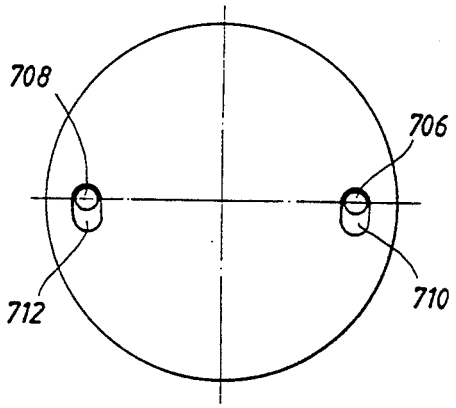

The spider buoy 20 includes a top edge reinforcing ring 204. Buoyancy is provided with a dough-nut shaped section 201 of foam or the like. Buoy 20 includes concrete ballast 202 and a plurality of anchor chain supports 21 connected to anchor chains 22. First and second slots 710, 712 are placed on the top surface of the buoy 20. Such slots are adapted to cooperate with first and second pins 706, 708 provided at the bottom end 32 of turret 10, in the process of obtaining rotational alignment of spider buoy 20 with turret 10 after axial alignment has been achieved. The angular placement of slots 710, 712 on the top face of spider buoy 20 is shown in FIGS. 10A and 10B.

The bottom end 32 of turret 10 includes first and second alignment pins 706, 708 mounted in lower turret support assembly 52. Such pins are angularly spaced 180 degrees from each other as further illustrated in FIGS. 10A and 10B. Hydraulic activators 707, 709 are adapted to selectively reciprocate pins 706, 708 from a retracted position, during connection operations, as shown in FIG. 6 to an extended position into respective slots 710, 712.

The bottom end of well 50 includes a plurality of fixed bumpers 700, preferably twelve in number arranged with equal spacing in a bottom recess 721 of the vessel. The bottom faces of such fixed bumpers 700 are approximately aligned with the bottom of the vessel 5. A plurality of active bumpers 702 are also preferably arranged at the bottom of well 50. Preferably the system includes at least four equally spaced bumpers which may selectively be activated by hydraulically powered bumper actuators 704 which are mounted to the well 50. Such bumpers aid in rotational alignment after the buoy 20 is axially aligned with turret 10.

The top of the spider buoy includes guide ring 207 which is adapted to fit within annular space 33 between lower structure ring 35 and the exterior surface of collet connector 210.

In operation, FIG. 6 shows the buoy prior to touching of a bumper 700, with for example, the buoy 20 axially misaligned with the center line 100 of turret 10.

Figure 7:
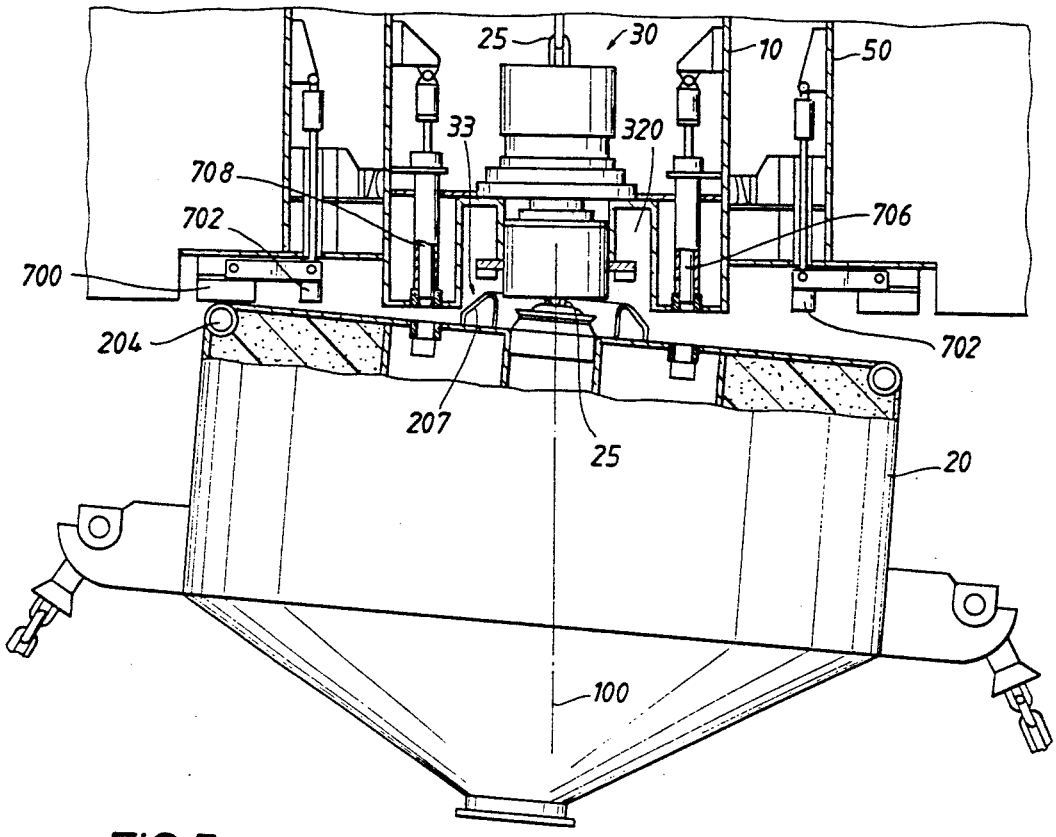

FIG. 7 shows the buoy 20 after it has been raised into partial engagement with bumper 700 through the upward pulling force on mooring chain 25. A portion of top edge reinforcing ring 204 has engaged fixed bumper 700 and guide ring 207 of the buoy 20 is entering the annular space 33 at the bottom of turret 10. Active bumpers 702 have not been activated, and alignment pins 706, 708 have not yet been activated.

Figure 8:
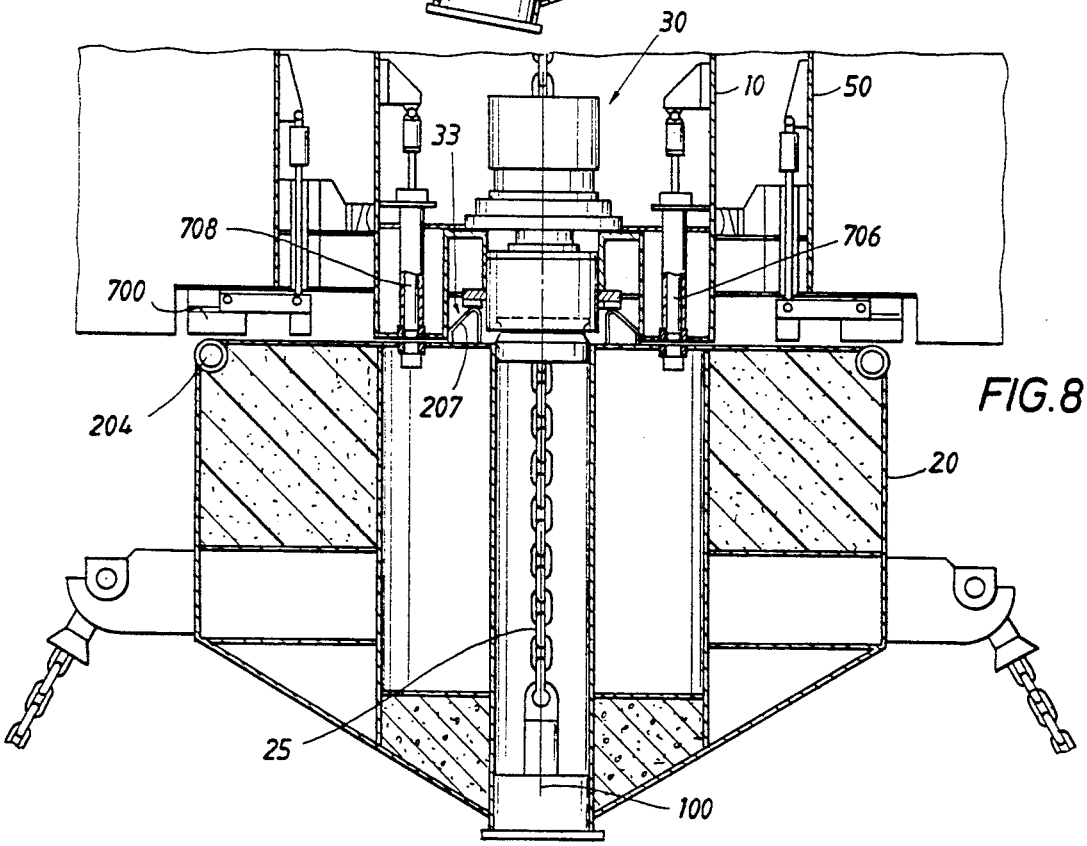
Figure 9:
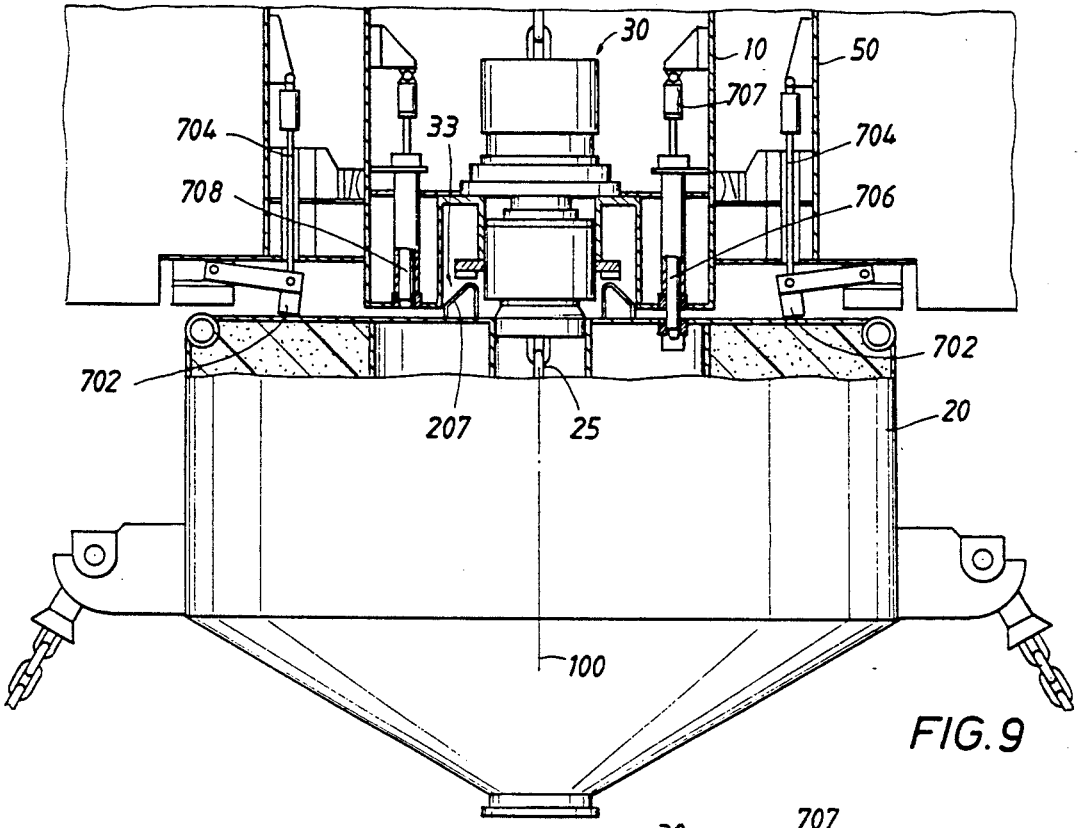

FIG. 8 shows the spider buoy 20 in axial alignment with turret 10. Guide rings 207 are within space 33. Although axial alignment has been achieved, rotational alignment must now be achieved. FIGS. 9, 10A and 10B illustrate rotational alignment.

Before connection operations near completion, the turret 10 is rotated with respect to well 50 (vessel 5) by means of turret hydraulic drive motors 592 (illustrated in FIG. 5). It is assumed that a mark on the top end of the turret represents rotational alignment which has been previously aligned with a compass heading. Accordingly, an operator on the vessel turns the turret (before it is connected to the spider buoy) to align the mark on the turret to the compass heading which has been predetermined to achieve rotational alignment. It is assumed that such actual operational rotation will be within a certain angular range of actual rotational alignment.

As illustrated in FIGS. 10A and 10B, slots 710, 712 have radial width W and angular length L. Such angular length L in designed to be approximately the same as the predetermined rotational alignment angle mentioned above. Such angle is preferably about 7½ degrees. The slots 710, 712 are placed radially to correspond to the radial placement of pins 706, 708. Since the turret has been operationally turned to ± the angular length of rotation L, one or the other of the pins 706 or 708 will be rotationally aligned with its respective slot. FIG. 10A illustrates the case where only pin 706 can fit within its designated slot, 710. At that point, actuator 707 forces pin 706 downward into slot 710 as illustrated in FIG. 9. If pin 708 meets downward resistance, an operator knows that the rotation is as that depicted in FIG. 10A and that the turret must be rotated in the counter clockwise direction, thereby bringing pin 706 to its most counter clockwise position within slot 710 and bringing pin 708 into the most clockwise alignment within slot 712. Of course the rotation is opposite if pin 708 initially fits within slot 712 but pin 706 does not.

In order to accomplish such rotation after axial alignment, FIG. 9 shows that active bumpers 702 are hydraulically driven downwardly such that a small clearance exists between the top of spider buoy 20 and the bottom of turret 10 and well 50. Accordingly, turret 10 may be rotated with respect to well 50 by turret drive motors 592 with only minimal frictional drag.

After pin 708 enters slot 712, for example, rotation of the turret ceases, bumpers 702 are retracted and the tension connector is activated to apply pre-load tension to collet connector 209.

Figure 11:
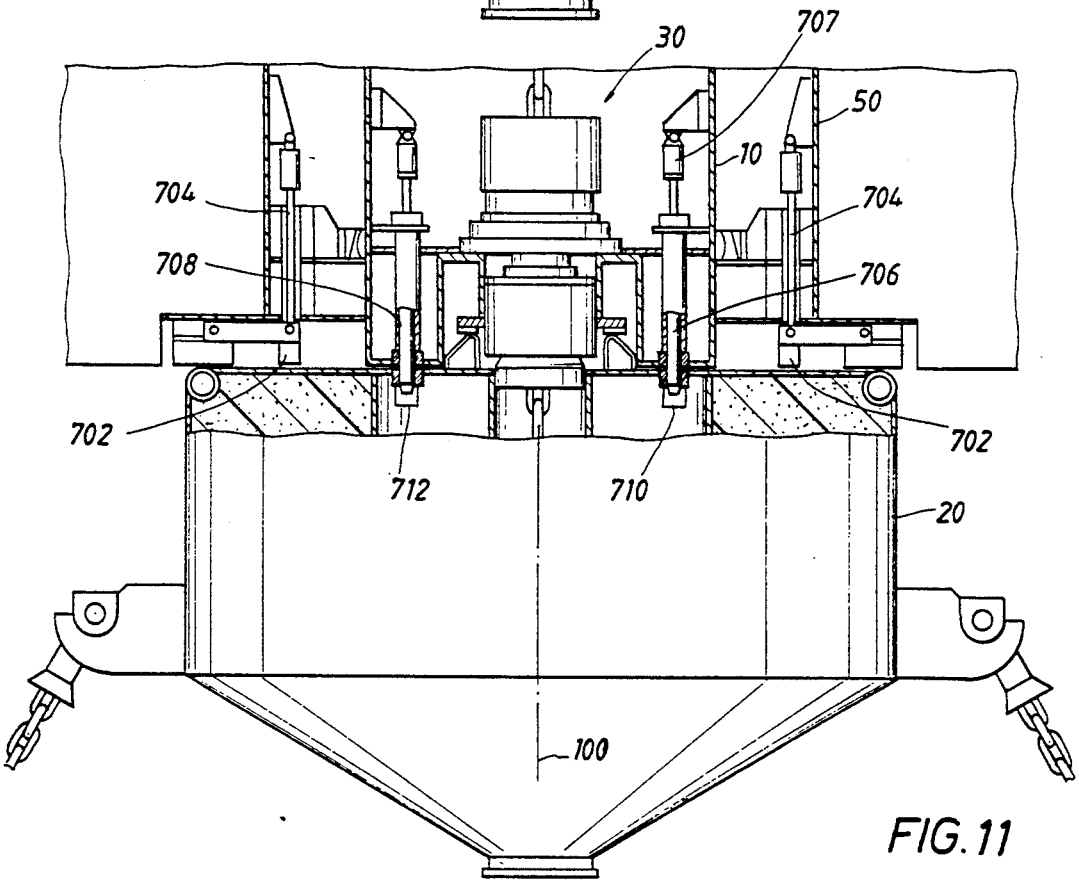

With the axial and rotational alignment achieved as illustrated in FIG. 11 and pre-load tension established in the hydraulic connector 30 between turret 10 and buoy 20, running tools may be applied in turret guide tubes 11 (see FIG. 3) to grasp flexible risers 24 to bring them to an upper position on the vessel for connection to flow lines leading to a product swivel assembly encompassing one or more swivels.

ALTERNATIVE EMBODIMENT OF STRUCTURES OF THE MOORING BUOY AND THE BOTTOM OF THE TURRET TO FACILITATE CONNECTION

Figure 6A:
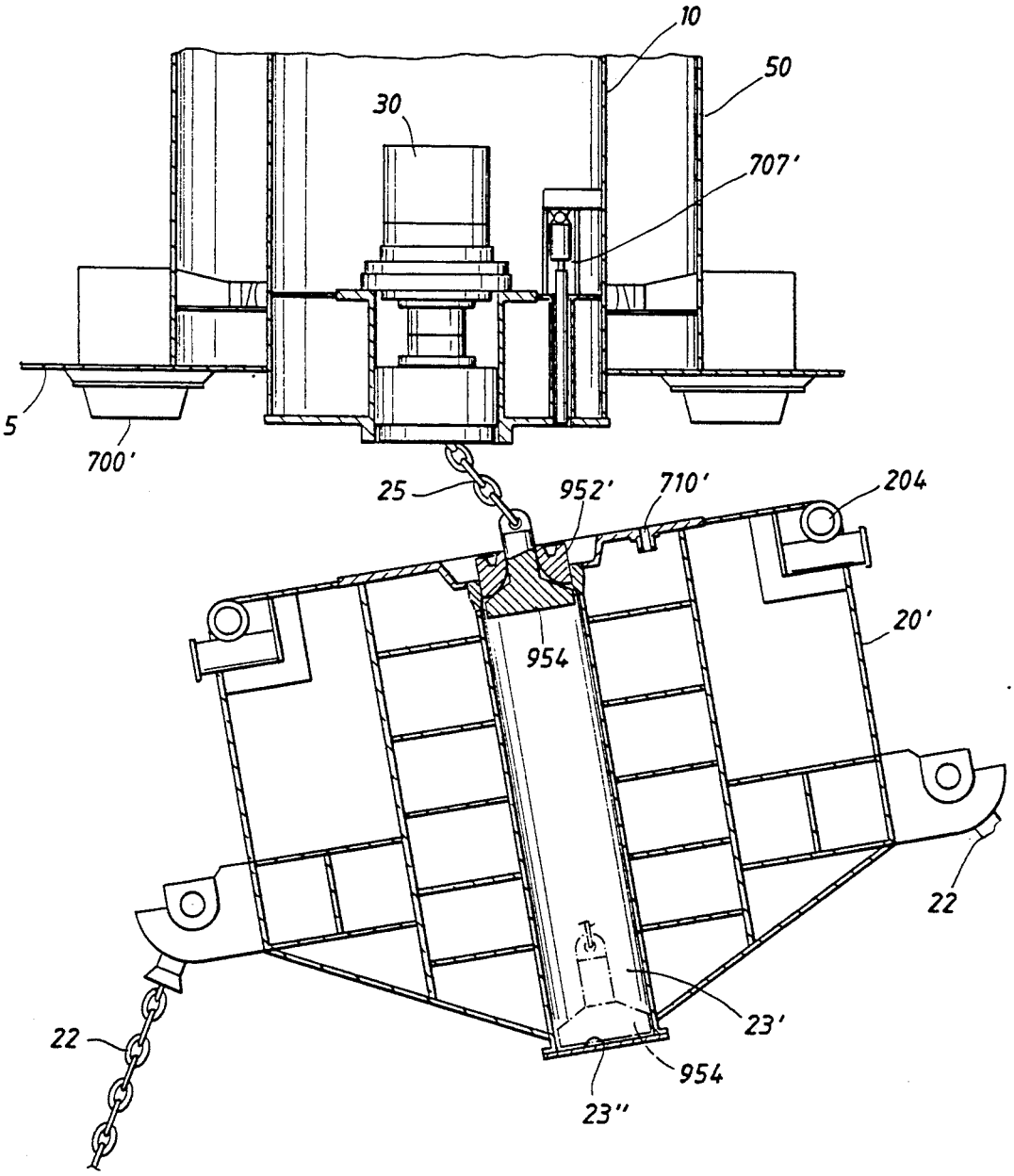

FIGS. 6A and 6B illustrate an alternative embodiment of the bottom profile of the turret 10 and vessel 5 and the complimentary top profile of the mooring buoy 20'. Passive bumper assemblies 700' are provided on the vessel 5 bottom around the opening of the well 50. As best seen in FIG. 6B, the bottom of the turret includes a turret chain guide 950 having a male circular ridge 951 which faces downwardly.

The top of the mooring buoy 20' includes a buoy chain guide 952 which has a circular female groove 953 adapted to receive the male circular ridge 951 of the chain guide portion 950 of turret hydraulic connector. Bear claw 213 of the hydraulic connector assembly locks guide 952 of the mooring buoy 20' and the guide 950 of the turret together.

FIG. 6A illustrates chain plug 954 to which chain 25 is secured at its top center. Plug 954 is shaped so that when the mooring buoy is being pulled into engagement with the bottom of turret 10, plug 954 is pulled upwardly in chain locker 23' with the result that it is wedged into the opening of buoy chain guide 952. After mooring buoy 20' is connected to turret 10, upward pulling on chain 25 stops and chain 25 is released to fall with plug 954 to the bottom 23'' of chain locker 23'.

Chain plug 954 is shown in phantom at the bottom of chain locker 23' to illustrate its position when claim 25 is stored in such chain locker 23' for example when the mooring buoy is positioned beneath the sea prior to connection with the vessel. The plug 954 includes a bottom surface or plate 955 which has an outer diameter somewhat smaller than the inside diameter of the chain locker 23'. As a result, when the chain 25 is pulled upwardly so as to pull buoy 20' toward vessel 5, chain plug 954 is pulled upwardly also. Its upward motion is retarded by restricted water flow through the annulus formed by the plate 955 and the wall of cylindrical chain locker 23'. Accordingly, the combination of the plate 955 of plug 954 and cylindrical chain locker 23' acts as a damper on upward motion of plug 954 as it is pulled upwardly. Damping of such motion prevents damage to plug 954 and guide 952 when plug 954 is pulled upwardly during connection operations.

The profiles of the bottom of the turret 10 and the top of buoy 20' in combination with the plug 954 and its center attachment for chain 25 are advantageous in that greater pull angles may be achieved than with the embodiment of FIG. 6 for example.

FIG. 6A also illustrates an alternative, single powered alignment pin 707' adapted to fit within a single alignment hole 710' in the top of mooring buoy 20'.

In operation, turret 10 is turned relative to the vessel 5 until the turret 10 is rotationally aligned with the top of mooring buoy 20' at which time alignment pin 707' can fit within alignment hole 710'.

LOWER BEARING ASSEMBLY

FIGS. 12, 13 and 14 illustrate the lower bearing assembly 54 according to the invention. Such assembly is placed axially (as illustrated in FIGS. 2, 3 for example) at approximately the axial position of tension connector 30 so as to minimize bending moments between spider buoy 20 and turret 10 and the connector 30. The lower bearing assembly 54 includes a plurality (preferably 16 in the case illustrated) of radial bearing assemblies 540, each of which bears against an outside surface of turret 10.

A cross section along lines 13—13 of FIG. 12 is presented in FIG. 13. A top view of such radial bearing assembly 540 is presented in FIG. 14.

The turret 10 includes a lower turret section machined surface 110 which includes a peripheral surface having corrosion resistant characteristics 112. Radial support against such surface 112 of turret 10 is provided by bushing segment 514 which has a curved inner surface which approximately matches the curved outer surface of lower machined turret section 110. Bushing segment 514 is carried by bushing block 547 rollingly supported from support block 544. Support block 544 is supported by support member 543 fixed to a structural support of lower turret support assembly or ring 52.

Each bushing 547 is radially adjusted when turret 10 is inserted within lower bearing assembly 54, so as to cause it to bear against a portion of the outer cylindrical surface of turret 10. Such adjustment is accomplished by shims 551 in cooperation with wedge 553. Wedge retainer 555 and locking nuts 557 force wedge 553 downward when locking nuts are turned down on threaded studs. Wedge 553 forces shims 551 and support block 544 inwardly so as to cause bushing block 547 to engage bushing 514 against lower turret journal 110. Of course radially outward adjustment may also be accomplished with such mechanism.

As best seen in FIG. 14, bushing 547 is carried by a carrier plate 549 secured to the top of bushing block 547 and pivotally supported from outer arms of support member 543. The inwardly facing partial circular cross section seat 545 and the outwardly facing circular surface 561 of bushing 547 allow the bushing 547 to self adjust, with respect to its support member 543, where the turret journal 110 has its axis not exactly aligned with that of lower bearing assembly or where the outer surface of turret journal 110 is not precisely round. When the axis of the turret is not parallel with the axis of the lower bearing assembly, the ball surface 561 may pivot a small amount in the vertical direction on seat 545 of support block 544. When the surface 112 of lower turret section 110 is not precisely round or small clearances exist, bushing segment 514 may follow radial changes in contact surface by bushing 547 rolling a small horizontal distance within seat 545 of support block 544. As a result of such construction, automatic alignment of each radial bearing assembly 540 is achieved for a turning turret 10 within lower bearing assembly 54. Such automatic alignment occurs not only for the axis of the turret 10 not being precisely aligned with the axis of the bearing assembly, but also when the outer surface of the turret is not precisely round and or small clearances exist.

MANUFACTURE OF TURRET

Figure 15A:
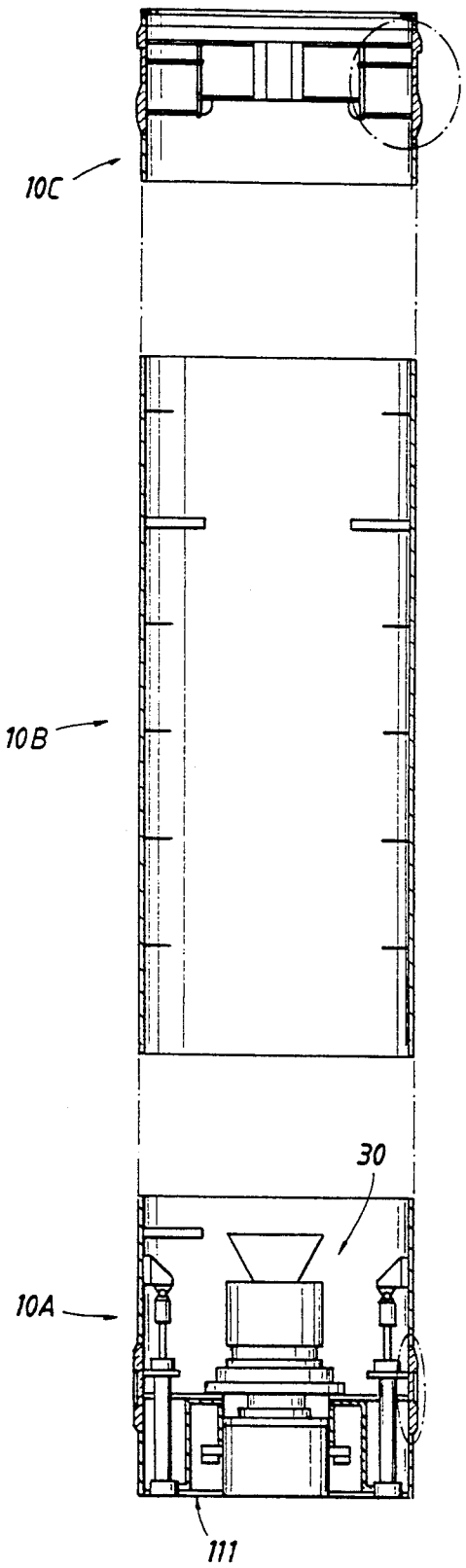
FIGS. 15A, 15B and 15C illustrate the manufacture of the turret of the invention in three separate sections.
Figure 15C:
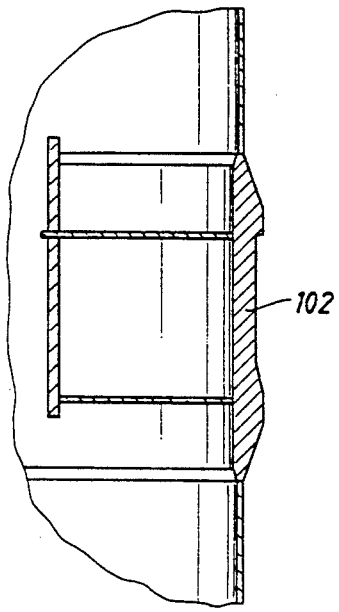
Figure 15B:
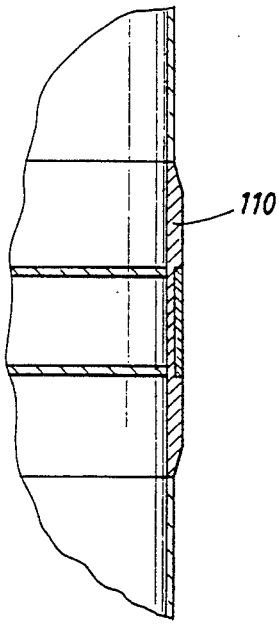

FIGS. 15A, 15B and 15C illustrate an important feature of the invention relating to the manufacture of turret 10 prior to its installation on vessel 5. As illustrated in FIG. 15, the turret 10 is fabricated in three separate sections. A lower section 10A is separately fabricated including an outer machined surface 110 (see FIG. 15B and FIG. 13) and support structure with tension connector 30. Furthermore, as illustrated only schematically in FIG. 15A, certain bottom surfaces 111 of the bottom of the turret must also be machined. Such surfaces are illustrated more clearly, for example, in FIGS. 6, 7, 8 and 9.

A middle section 10B is a generally cylindrical section. A top section 10C includes an upper turret section machined surface 102. The manufacture of turret 10 in shorter lengths as illustrated in FIG. 15A enables the practicability of machining very large diameter sections 102 and 110 as compared to the impracticability of manufacture if such machining were done on the entire turret. After fabrication and testing, the sections 10A, 10B and 10C may be joined end to end by welding, for example.

MAKE UP TESTING OF BUOY AND TURRET BOTTOM

Figure 16:
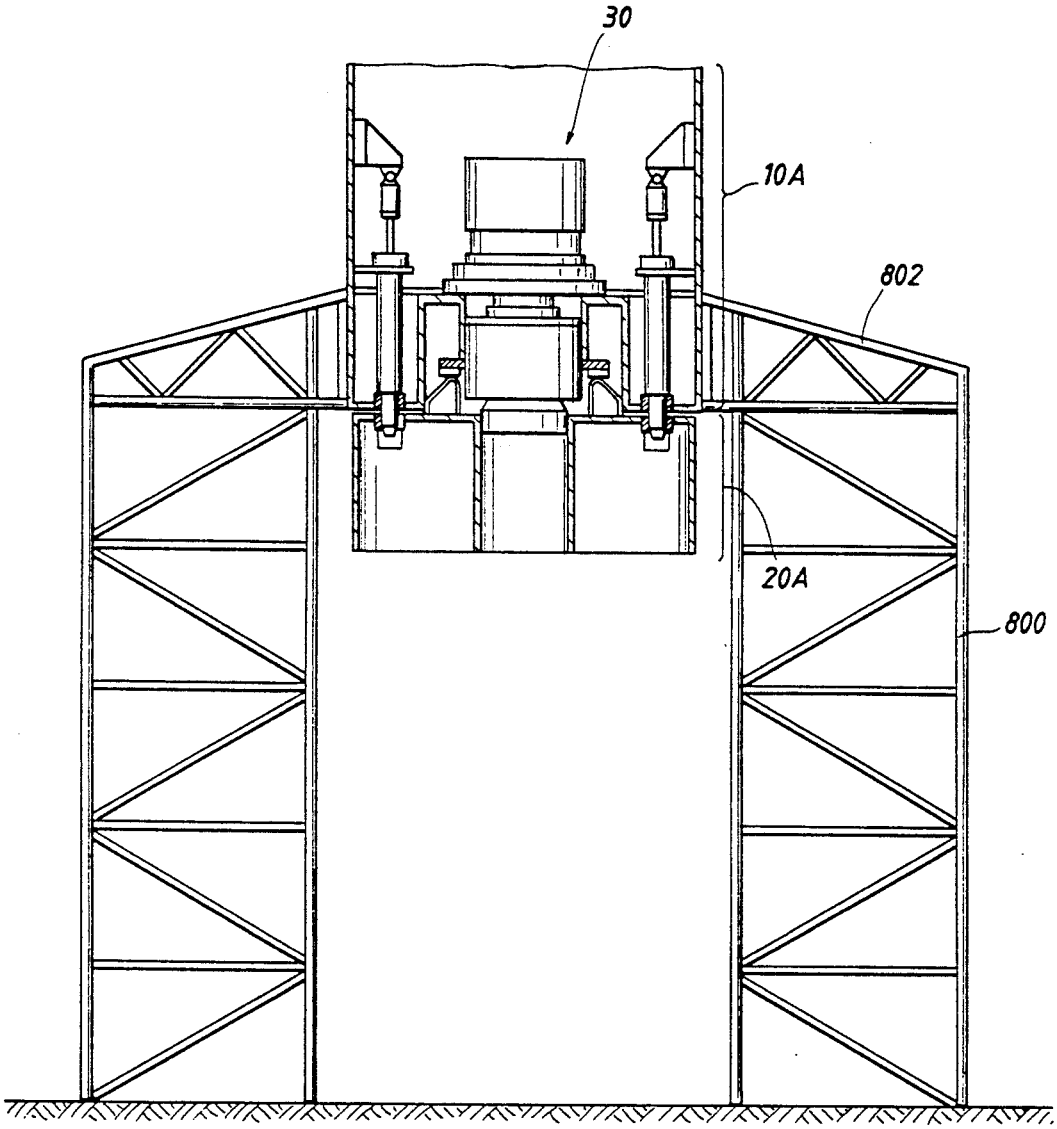
FIG. 16 illustrates the test stand testing of the mating and connection of the bottom section of the turret and a portion of the spider buoy during manufacture prior to installation of the turret on the vessel.

FIG. 16 illustrates a preferred method of testing lower section 10A of turret 10 for its mating capability with a central section 20A of buoy 20. A test stand 800 is provided, in a manufacturing facility, by which lower turret section 10A may be securely fastened, for example by structure 802. The lower section 20A of the buoy is then pulled upwardly for axial and angular alignment with turret section 10A. As such mooring buoy section 20A approaches the bottom end of the lower turret section 10A, all of the manufacturing tolerances between mating elements may be observed, measured and altered if necessary.

Such testing before actual deployment in the sea and a connection at sea provides manufacturing assurance that the turret and spider buoy actually are dimensionally compatible so as to allow connection. Furthermore, the operation of pre-load tension connector 30 may be first tested to its full capacity at the manufacturing facility, rather than at sea where the turret is connected to the spider buoy.

CONNECTION AND DISCONNECTION OPERATIONS AT SEA

FIGS. 17A through 17G illustrate operational steps for connection of a production vessel 5 to a submerged spider buoy 20. FIGS. 17H and 17I illustrate disconnection steps.

FIG. 17A illustrates the state of spider buoy 20 after it comes to equilibrium in the sea. Such equilibrium depth may for example be at about 100 feet beneath the surface 7 of the sea. A strong lighter-than water messenger line 900 stored in funnel shaped structure 790 atop connector 30 (see FIG. 3) which is secured to retrieval chain 25 has one end floating on the sea surface 7 with its other end secured to the retrieval chain 25 which is stowed in the chain locker of the buoy 20.

FIG. 17B illustrates a vessel 5 arriving at the location of the spider buoy 20. A retrieval wire 902 is lowered into the sea through the turret 10 of vessel 5 and the end of such line 902 is retrieved by picking up the end of line 902. The end of line 902 is then secured for future connection to messenger line 900.

FIG. 17C shows that through the use of grappling equipment or a work boat, messenger line 900 is retrieved while withdrawing the mooring chain 25 from the chain locker of the spider buoy 20. With the end of the chain assembly picked up and secured by a chain stopper at deck 3, the end of line 902 is connected to the end of retrieval chain 25 and the messenger line 900 is disconnected.

Figure 17D:
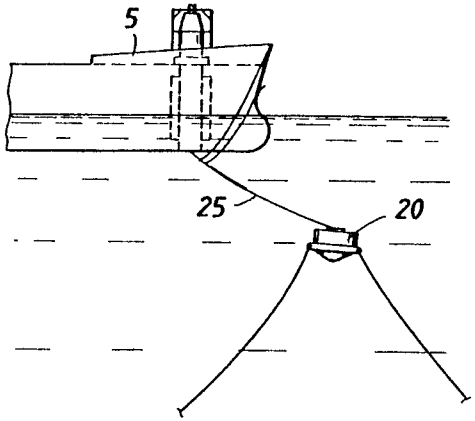

FIG. 17D illustrates that a soft line and deck capstan/winch is used to lower a retrieval line assembly into the water while hauling in on a retrieval winch to avoid excess slack. With the soft line unloaded, its end at the deck is released and pulled through an open fitting in the retrieval line assembly to release it.

Figure 17E:
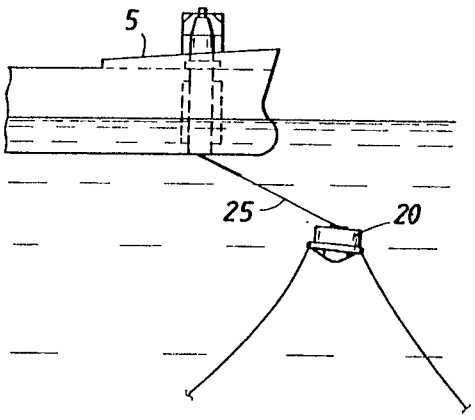

FIG. 17E illustrates the slow retrieval of buoy 20 by the retrieval winch until loads increase when the spider buoy is within a few yards of the vessel.

Figure 17F:
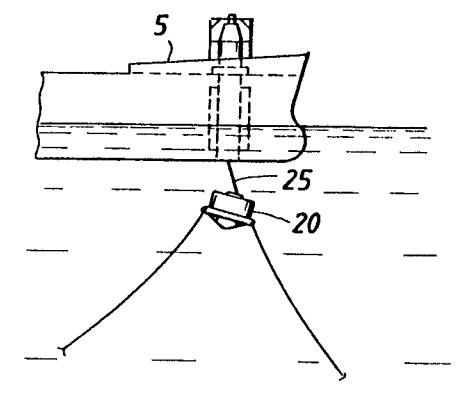

FIG. 17F illustrates the condition where the chain jack in the turret shaft is engaged and begins slowly heaving the buoy 20 up to connection position. Such chain jack preferably has pulling capability in excess of 450 tons. (Of course such pulling capability could be less for smaller vessels and less severe sea conditions.) The turret shaft is rotated with respect to vessel 5 using hydraulic drive motors until the turret 10 and spider buoy 20 are aligned to a predetermined angle (for example, preferably within $\pm 7.5°$).

Figure 17G:
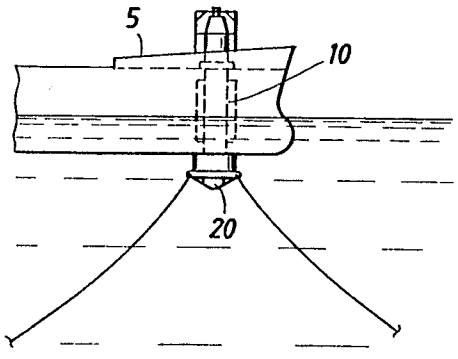
Figure 17H:
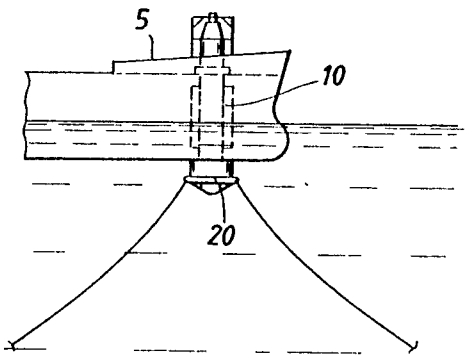
Figure 17I:
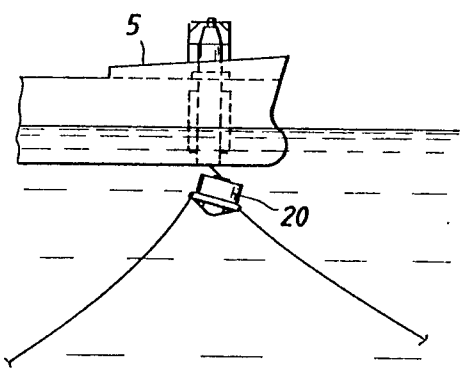

FIG. 17G illustrates the connection operations. With the buoy 20/turret 10 aligned within $\pm 7.5°$, one of the two alignment pins will be inserted within one of the spider buoy alignment slots. The specific pin inserted is determined and the necessary rotation direction of the turret with respect to the vessel is determined. The hydraulic drive motors are used to rotate the turret to the proper rotational alignment and both antirotation pins are inserted into slots on the upper face of buoy 20. The active bumpers may be used to facilitate rotation of the turret when the spider buoy is beneath it.

FIG. 17H illustrates the condition where next actions are taken. The tension connector is latched to the spider buoy and pre-load is applied. The retrieval chain is lowered into the chain locker of the spider buoy. The interior of the turret is pumped free of sea water and the retrieval wire from the retrieval chain is disconnected and spooled onto the winch. Using appropriate handling gear and connection tools, the riser assemblies are lifted and connected to piping inside the turret near the main deck level. Finally, the messenger line is re-connected to the retrieval chain and re-rigged in the funnel structure atop the tension connector and secured for future deployment. Connection is complete.

FIG. 17I illustrates disconnection steps. First, piping is disconnected from the risers inside the turret at the main deck. Risers are then lowered to their support on the spider buoy 20 and released. The buoy is then disconnected by hydraulic activation of the tension connector.

MESSENGER LINE STORAGE

Figure 18:
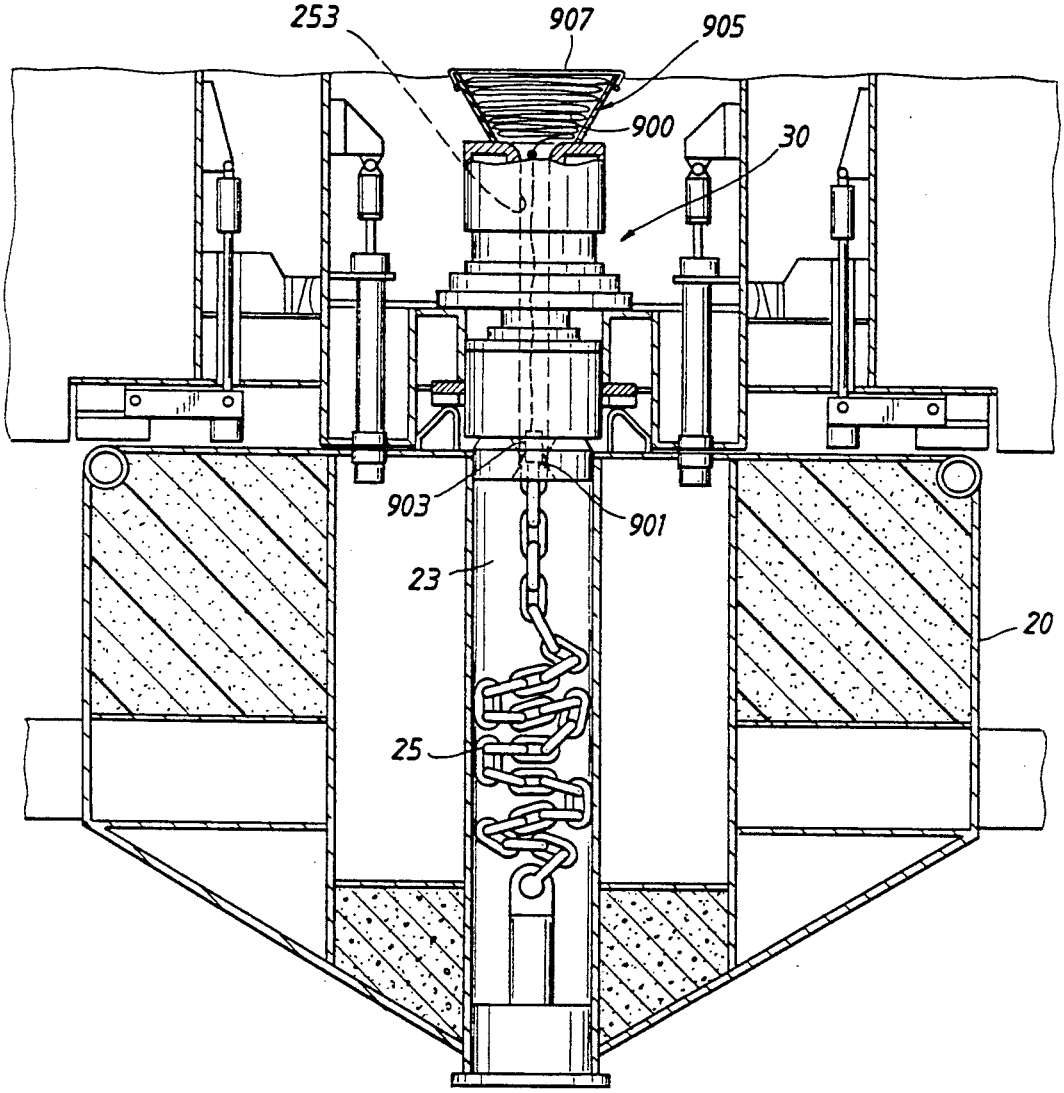
FIG. 18 illustrates an arrangement for storing a buoyant messenger line for automatic deployment when the vessel disconnects from the spider buoy.

FIG. 18 illustrates storage apparatus by which messenger line 900 is stored prior to disconnection of spider buoy 20 from turret 10. A funnel shaped structure 905 is secured to the top of connector 30. Messenger line 900 is placed inside of funnel 905 with its lower end connected to the upper end of retrieval chain assembly 25 at fitting 901 by connecting link 903. The placement of line 900 within funnel structure 905 may take the form of folded layers, as indicated in FIG. 18 or coils about the interior of funnel 905. A securing net 907 covers the top of funnel 905.

In operation, when turret 10 is disconnected from spider buoy 20 by operation of connector 30, the spider sinks into the sea and pulls messenger line 900 through passage 253 with it. After all of messenger line is deployed into the sea, the top portion of it risers to the sea surface.

Various modifications and alterations in the described apparatus will be apparent to those skilled in the art of the foregoing description which does not depart from the spirit of the invention. For this reason, these changes are desired to be included in the appended claims. The appended claims recite the only limitations of the present invention and the descriptive manner which is employed for setting forth the embodiments and is to be interpreted as illustrative and not limitative.

What is claimed is:

1. An improved detachable vessel mooring system including a vessel having a vertically aligned turret rotatably secured to its hull such that said hull and turret may rotate with respect to each other with the bottom end of said turret facing downwardly toward the sea and including a buoyant mooring element and a plurality of mooring lines extending between and connected to said mooring element and the sea floor and including a selectively operable hydraulic connector assembly having a collet flange hub mounted at the top of said mooring element and a hydraulic collet connector mounted to the bottom of said turret, wherein the improvement comprises winch means disposed on a deck of said vessel, a passage extending through said hydraulic connector assembly, said buoyant mooring element including a chain locker, said chain locker including a restricted passage at its top end, said chain locker including a plug dimensioned to move within said chain locker from its bottom to its top, and a chain connected to a center point of said plug and extending through said passage of said hydraulic connector assembly to said winch means, whereby when said mooring element is being winched in via said chain, said plug is pulled to a top end of said chain locker with said chain being pulled from said center of said plug at the center of said mooring element, and when said chain is released from said winch means, said plug is free to fall to the bottom of said chain locker with said chain for storage of said chain.

2. The improved detachable vessel mooring system of claim 1 wherein the improvement further comprises, said plug having a plate, the outside dimension of which is smaller than the inside diameter of said chain locker thereby creating an annulus between the outside of said plate of said plug, whereby upward motion of said plug is retarded by restricted water flow through said annulus.

* * * * *